US008850681B2

(12) United States Patent
Hardigg et al.

(10) Patent No.: US 8,850,681 B2
(45) Date of Patent: Oct. 7, 2014

(54) MODULAR CASE AND METHOD OF FORMING THE SAME

(71) Applicants: James S. Hardigg, Conway, MA (US); Mark Gaydos, Greenfield, MA (US); George Havrilla, South Deerfield, MA (US); Robert Milliken, Conway, MA (US)

(72) Inventors: James S. Hardigg, Conway, MA (US); Mark Gaydos, Greenfield, MA (US); George Havrilla, South Deerfield, MA (US); Robert Milliken, Conway, MA (US)

(73) Assignee: Hardigg Industries, Inc., South Deerfield, MA (US)

( * ) Notice: Subject to any disclaimer, the term of this patent is extended or adjusted under 35 U.S.C. 154(b) by 0 days.

(21) Appl. No.: 14/010,972

(22) Filed: Aug. 27, 2013

(65) Prior Publication Data

US 2013/0340235 A1 Dec. 26, 2013

Related U.S. Application Data

(62) Division of application No. 11/399,206, filed on Apr. 6, 2006, now Pat. No. 8,640,911.

(51) Int. Cl.

| | |
|---|---|
| ***B23P 11/02*** | (2006.01) |
| ***B65D 6/00*** | (2006.01) |
| ***B65D 21/02*** | (2006.01) |
| ***B65D 6/34*** | (2006.01) |
| ***B65D 6/10*** | (2006.01) |

(52) U.S. Cl.

CPC ..... *B65D 21/0209* (2013.01); *B65D 11/10* (2013.01); *B65D 11/22* (2013.01); *B65D 11/16* (2013.01)

USPC ..... 29/415; 29/412; 29/417

(58) Field of Classification Search

CPC .... B65D 21/0209; B65D 11/22; B65D 11/16; B65D 11/10

USPC ..... 29/450, 412, 415, 417

See application file for complete search history.

(56) References Cited

U.S. PATENT DOCUMENTS

| | | | | |
|---|---|---|---|---|
| 3,153,491 | A | 10/1964 | MacTavish et al. | |
| 3,530,535 | A * | 9/1970 | Sachs | 425/197 |
| 3,616,943 | A | 11/1971 | Brink | |
| 3,662,507 | A * | 5/1972 | Espeland | 52/270 |
| 3,955,702 | A | 5/1976 | Lundy | |
| 5,191,994 | A | 3/1993 | Stauble | |

(Continued)

FOREIGN PATENT DOCUMENTS

| | | |
|---|---|---|
| JP | S56-151681 | 11/1981 |
| JP | S60-45142 | 3/1985 |

(Continued)

*Primary Examiner* — David Bryant
*Assistant Examiner* — Ruth G Hidalgo-Hernande
(74) *Attorney, Agent, or Firm* — McCormick Paulding & Huber LLP

(57) ABSTRACT

A modular case and method of forming the same, the case preferably formed from a plurality of panels, edge members and corner pieces having ribs. The panels, edge members and corner pieces are preferably connected to align the ribs, forming substantially continuous ribs capable of distributing forces over a large area of the modular case. The case is most preferably made of plastic, the connections preferably being hot-plate welds. Most preferably, the panels and edge members have a dual skin construction with internal ribs, proving for greater strength and allowing for superior structural properties including air-/water-tight integrity. Edge members are preferably formed with protuberances to allow for better base-to-lid and case-to-case engagement. Hardware attachments to the modular case can be advantageously made while distributing the force on attachment points and without compromising structural integrity.

6 Claims, 18 Drawing Sheets

(56) References Cited

U.S. PATENT DOCUMENTS

| | | | | | |
|---|---|---|---|---|---|
| 5,287,981 | A | | 2/1994 | Wheeler | |
| 5,322,213 | A | | 6/1994 | Carter et al. | |
| 5,720,403 | A | * | 2/1998 | Sawyer | 217/65 |
| 5,736,221 | A | | 4/1998 | Hardigg et al. | |
| 5,845,799 | A | | 12/1998 | Deaton | |
| 6,141,926 | A | * | 11/2000 | Rossiter et al. | 52/239 |
| 6,158,878 | A | * | 12/2000 | Lawrence | 362/238 |
| H2183 | H | | 3/2007 | Wood | |

FOREIGN PATENT DOCUMENTS

| | | |
|---|---|---|
| JP | H06-42656 | 6/1994 |
| JP | H08-156942 | 6/1996 |
| JP | H11-504880 | 11/1999 |
| JP | H11-278479 | 12/1999 |
| JP | 2004-331163 | 11/2004 |

* cited by examiner

MODULAR CASE AND METHOD OF FORMING THE SAME

FIELD OF THE INVENTION

This application is a divisional of U.S. patent application Ser. No. 11/399,206, filed on Apr. 6, 2006, entitled "Modular Case and Method of Forming the Same" herein incorporated by reference in its entirety. This invention relates generally to a modular case and method of forming the same, and more particularly to a modular plastic case made from dual-skinned plastic panels with internal ribs, joined by various corner and connecting members with internal ribs, such that the internal ribs are aligned, allowing for a modular case enjoying superior structural qualities, such as strength, structural integrity, and stiffness, that can be cost-effectively produced in any desired size.

BACKGROUND OF THE INVENTION

In the past, cases for shipping and other applications have been fabricated from plywood panels (with or without plastic skins bonded to the surfaces) joined by attachment to metal edge members (usually by rivets). Such cases could be provided with handles and other attachments by cutting holes in the plywood panels, inserting the desired attachment and riveting the attachment in place.

Such cases were very susceptible to various types of damage when dropped, handled roughly, or generally subjected to localized impacts. The metal edge members were easily bent, the riveted attachments were easily broken or sheared, the holes cut for the attachments could become elongated, and the plywood panels were subject to splintering and delaminating.

Additionally, the cases made from plywood panels were particularly unsuitable for applications requiring an airtight or watertight case. Some air- and water-tightness could be achieved using sealants and gaskets, but the application of such sealants and gaskets was time-consuming and costly. Moreover, with rough handling, an air- or water-tight seal was difficult to maintain.

As cases, generally, and shipping cases particularly, are likely to experience rough handling and localized impacts, it is clear that a case with superior structural qualities is needed. Cases made from molded plastic (injection molding, rotational molding, thermoforming, blow molding, etc.) exhibited some of the desired structural qualities, but did not enjoy the design flexibility of the plywood panel cases.

That is, the plywood panel and metal edge members could be easily cut and sized for a wide range of required case sizes. To produce differently sized molded plastic cases with the desired structural qualities, however, would typically require a new dedicated mold for each separately dimensioned case. Thus a differently sized molded plastic case was expensive and time-consuming to produce. As a result, the design flexibility of the molded plastic cases was limited compared to the plywood panel cases.

With the foregoing problems and concerns in mind, the general object of the present invention is to provide a modular case, most preferably a plastic case, that enjoys superior structural qualities while matching or exceeding the design flexibility of plywood panel cases.

SUMMARY OF THE INVENTION

It is an object of the present invention to provide a modular case made from hot-plate welded plastic panels and plastic edge members.

It is a further object of the present invention to provide a modular case, wherein the plastic panels have ribs, the plastic panels being formed from inner and outer panel halves, each panel half having integral rib surfaces, the panel being formed by the two panel halves being hot-plate welded together on opposing integral rib surfaces.

It is a further object of the present invention to provide a fabricated plastic case wherein the panels and edge members have uniformly spaced ribs, and the panels and edge members are cut and connected such that ribs meeting at joints are joined end to end, providing a plurality of substantially integral ribs capable of effectively distributing forces about the modular case structure.

It is a further object of the present invention to provide a modular case with edge members that include molded protuberances and/or recesses for advantageous engagement between a lid and a base, or between two or more cases.

It is a further object of the present invention to take advantage of the inner and outer skin construction of the modular case panels and edge members, to provide mounting holes and inserts that allow a wide variety of attachments to be secured to the case while maximizing the strength and structural integrity of the case.

It is a further object of the present invention to provide separately pre-fabricated panels and edge members that can be separately cut-to-size to accommodate the manufacture of differently sized modular cases.

It is a further object of the present invention to provide panels and edge members that once joined become integral of one another, and provide a modular case that has greater impact resistance and water-tightness than known modular container systems.

These and other advantages of the present invention will be better understood in view of the Figures and preferred embodiment described.

DETAILED DESCRIPTION OF THE PREFERRED EMBODIMENT

Figure 1:
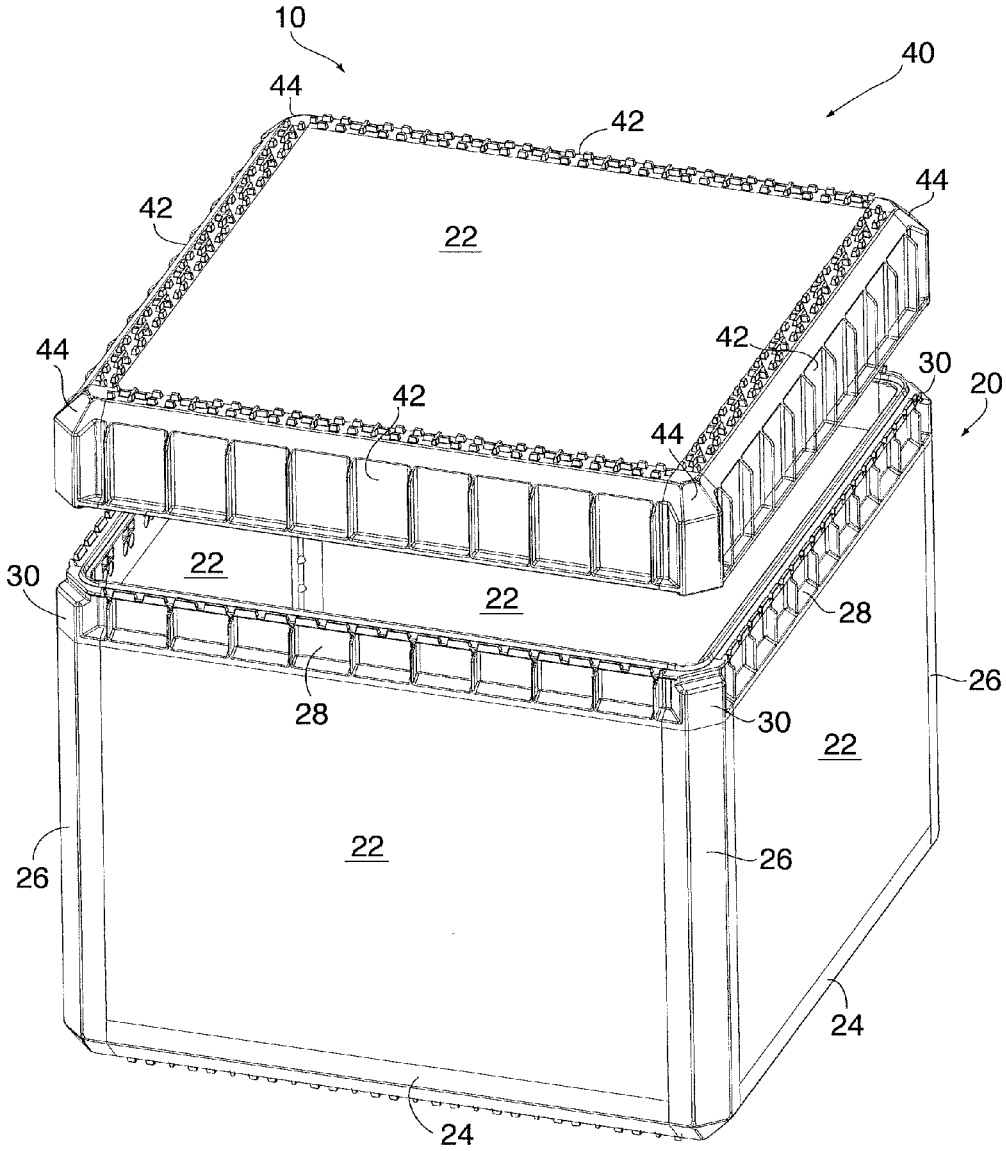
FIG. 1 shows a perspective view of a case (without optional hardware) according to the preferred embodiment of the present invention, with the lid lifted to show details.
Figure 2:
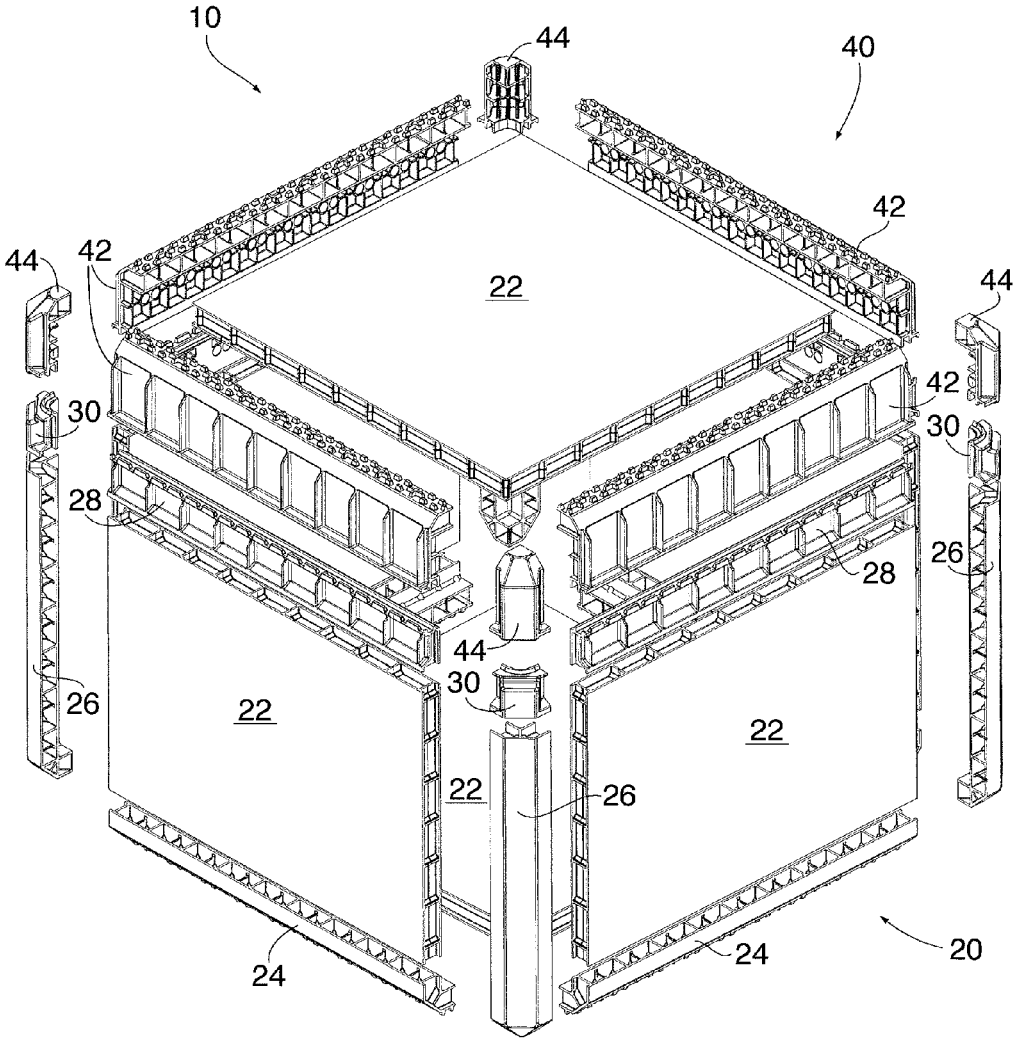
FIG. 2 shows an exploded view of a case according to the preferred embodiment of the present invention.

FIG. 1 shows a perspective view (FIG. 2 shows an exploded view) of a preferred embodiment of a modular case 10 according to the present invention. Plastic is the preferred material, though other suitable materials can be used within the scope of the present invention. Appropriate materials are selected based on design criteria such as required stiffness, weight, watertight integrity, and impact resistance. The case 10 is preferably composed of a base 20 and a lid 40. The base 20 is formed from a plurality of panels 22 (forming the bottom and four (4) vertical sides—collectively, case panels), base horizontal edge members 24, base vertical edge members 26, base parting line edge members 28 (collectively, case edge members), and parting line corner pieces 30. A lid 40 is formed from a panel 22, and a plurality of lid parting line edge members 42 and lid parting line corner pieces 44. The term "parting line" refers to the portion of a case where the base and lid meet. As will be discussed below, the base and lid parting line edge members and the corner pieces are preferably adapted to align with one another.

Typically, cases do not require deep lids. In the event a deeper lid is required, a deeper lid (not shown) is formed incorporating the vertical side panels 22 as in the base 20, except that a modified lid parting line capable of connecting to the bottoms of the lid vertical side panels (not shown) is used. Additionally, where a double-entry case (not shown) is required (e.g. for containing rack-mounted electronics), two lids 40 are used together with a midsection (not shown). The midsection is formed like the base 20, except no bottom panel and base horizontal edge members are used, and the resulting open area is surrounded by a second base parting line, such that the midsection is open on two ends, each end provided with a parting line for receiving a lid.

Panels, edge members, and corner pieces are preferably pre-fabricated stock. To create a case of desired dimensions X, Y, and Z, the top and bottom panels 22, base horizontal edge members 24, base parting line edge members 28, and lid parting line edge members 42 are cut from the pre-fabricated stock (master panels and edge members) to correspond to the desired X and Y dimensions. The first two side panels 22 are cut to correspond to the desired Y and Z dimensions and the second two side panels 22 are cut to correspond to the desired X and Z dimensions. The base vertical edge members are cut to correspond to the desired Z dimension. In precisely sizing the case in a given dimension, it is necessary to consider the thickness of the edge members in that direction. For example, the total height of the case in the Z dimension includes not only the height of panel 22 in the Z dimension, but also the combined thicknesses of the base horizontal edge member 24, base parting line edge member 28 and lid parting line member in the Z dimension. As a given edge member is preferably cut only to correspond to a single dimension (e.g. the base horizontal edge members are only cut to correspond to the X or the Y dimension), proper overall dimensioning requires proper sizing of the panels 22 to accommodate for the added width of the edge members.

The cut panels and edge members, together with the corner pieces, are then joined (the manner in which the joints are preferably formed is discussed in more detail below) to form the case 10. Preferably, all joints are hot plate welded, which provides a strong and air-/water-tight seal along the length of the weld. The lid 40 is typically not welded to the base 20, but removable to facilitate loading/unloading of the case 10 (various features of the parting line are discussed in more detail below). The order in which the modular components are cut and joined is not critical, but can be varied as required given assembly conditions.

From the foregoing, it can be appreciated that the present invention provides a case, especially a plastic case, that can easily be formed to any desired size by cutting modular elements from pre-fabricated stock (the master panels and edge members) and joining the elements together. In contrast to known plywood cases, and methods of making the same, it can be seen that the present invention provides panels, edge members, and corner pieces which become integral once hot-plate welded, enhancing strength and air-/water-tight integrity.

Figure 3:
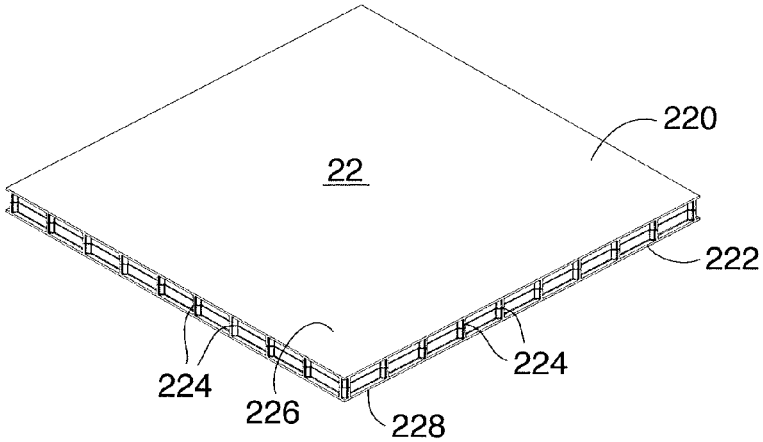
FIG. 3 shows a perspective view of a panel according to the preferred embodiment of the present invention.

Turning to the perspective view of the panel 22 shown in FIG. 3, it can be seen that the panel 22 is preferably formed having an outer skin 220, and an inner skin 222. A plurality of ribs 224 (better seen in FIG. 4) is provided between the outer skin 220 and the inner skin 222. Preferably, the panel 22 is formed from an outer panel half 226 and an inner panel half 228, each panel half being formed with integral half-ribs. The panel halves are preferably formed into the panel 22 by hot-plate welding the panel halves together on the opposing half-rib surfaces. (See FIG. 7 for a partial view of the panels 22 with inner panel half removed to show internal features.) U.S. Pat. No. 5,736,221 to Hardigg et al., hereby incorporated by reference in its entirety, discloses embodiments of panels formed in this fashion. A panel as described therein, though fabricated from plastic, provides better falling dart resistance than ½ inch plywood panels, even with a dart impact on a panel area with minimum rib support. Panel halves attached in other ways, as well as other types of panel construction known to those skilled in the art (including sheets with bonded ribs and extruded sheets with ribs) can be used. The type of panel used can be varied depending on design requirements like case stiffness, weight, and impact resistance. Although the preferred rib structure is shown in the Hardigg '221 patent, the term "rib" is used generically herein to indicate a reinforcing member, unless a particular structure is specified.

Figure 4:
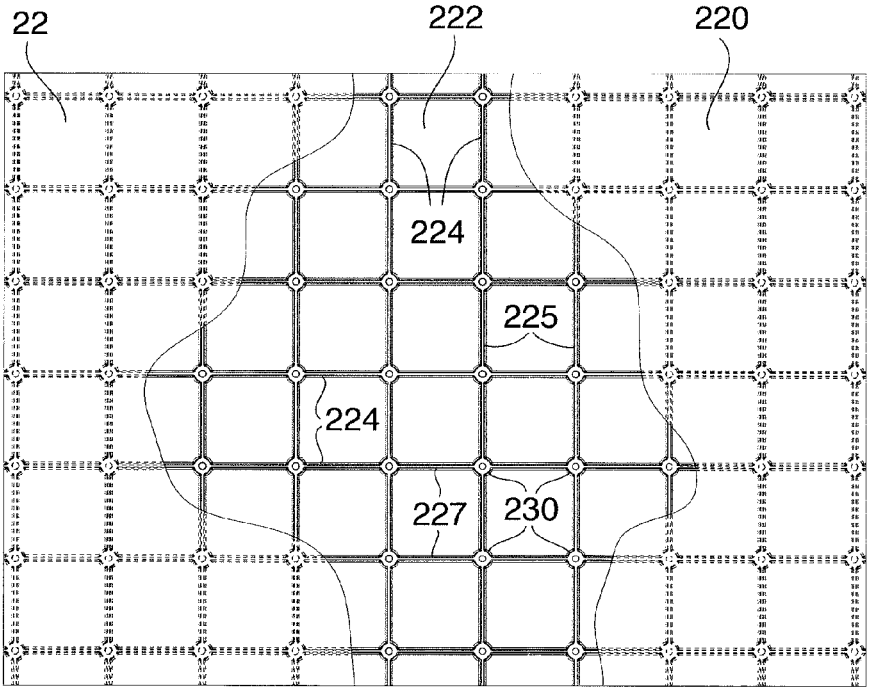
FIG. 4 shows a side view of a panel, partially cut-away to show details, according to the preferred embodiment of the present invention.
Figure 5E:
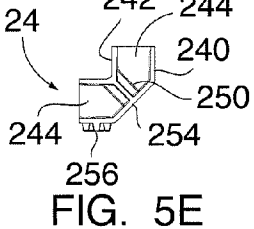
FIGS. 5A-G show various views of a base horizontal edge member according to the preferred embodiment of the present invention.
Figure 5F:
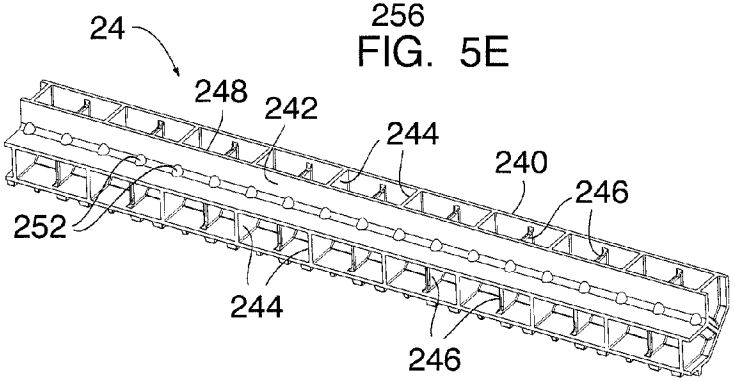
Figure 5G:
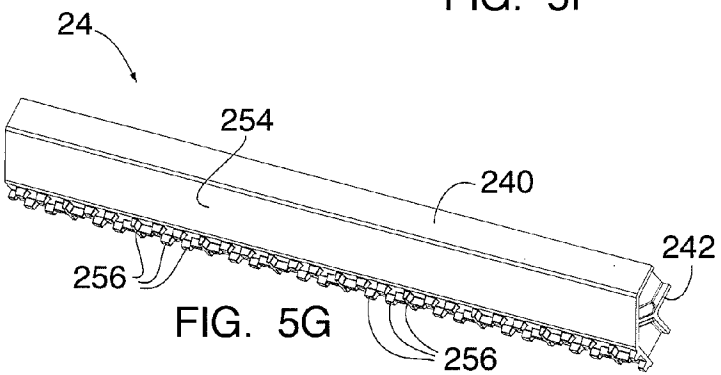
Figure 5A:
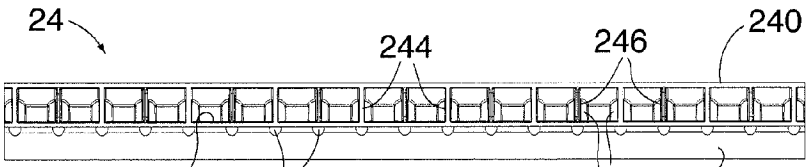
Figure 5B:
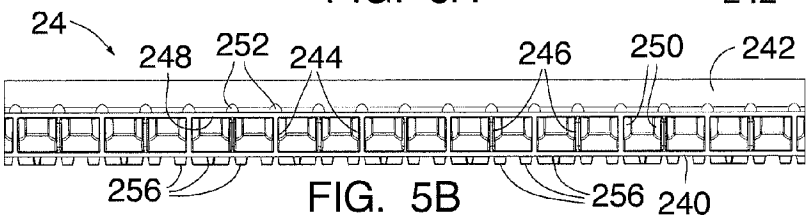
Figure 5C:
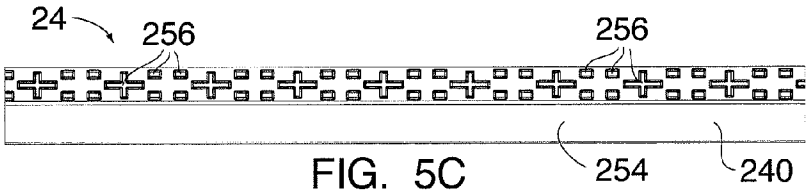
Figure 5D:
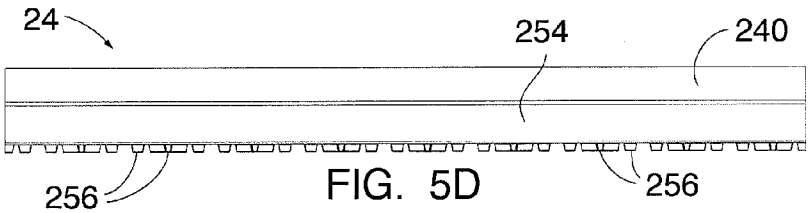
Figure 6E:
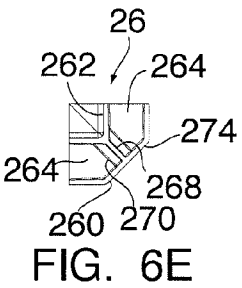
FIGS. 6A-G show various views of a base vertical edge member with integral corner according to the preferred embodiment of the present invention.
Figure 6F:
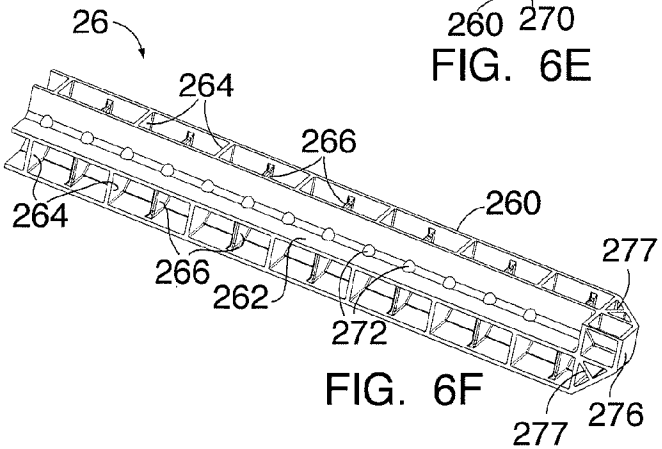
Figure 6G:
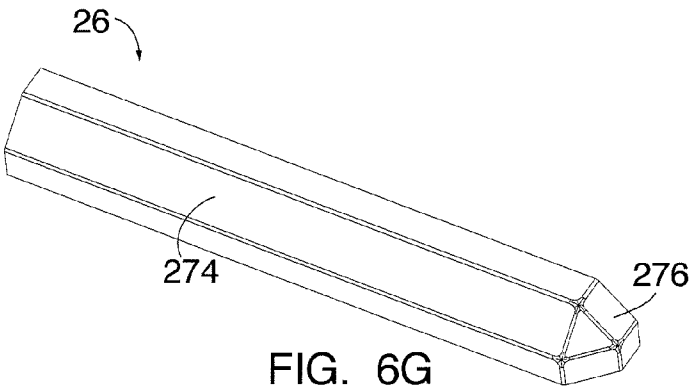
Figure 6A:
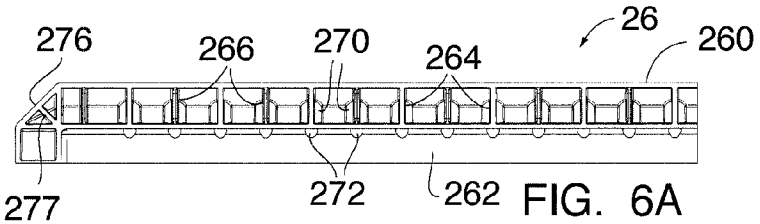
Figure 6B:
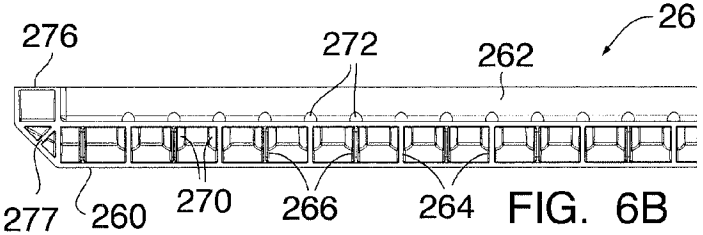
Figure 6C:
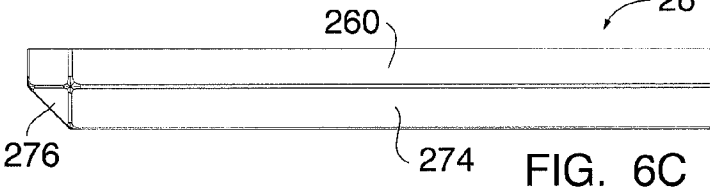
Figure 6D:
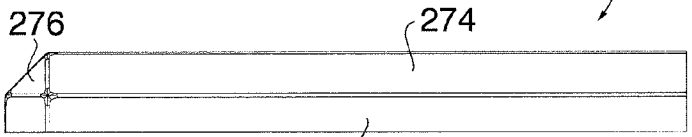

Internal features of the panel 22 are shown in FIG. 4, in which the panel 22 is partially cut-away. The ribs are preferably perpendicular to the outer skin 220 and the inner skin 222, though other alignments are within the scope of the present invention. As shown, the ribs 224 preferably include a plurality of parallel first ribs 225 and parallel second ribs 227. A plurality of rib intersections 230 are preferably formed substantially perpendicularly and optionally are formed as bosses, the boss being adapted to grippingly accommodate a threaded screw, or the like, inserted through the outer skin 220 or the inner skin 222 over the center of a boss 230. The spacing between any two adjacent parallel ribs 224 in the panel 22 is preferably equal; such that two intersecting first and second ribs 225, 227 form a square between the outer skin 220 and the inner skin 222.

The base horizontal edge member 24 will now be described, referring to FIGS. 5A-G, which show various views of the base horizontal edge member 24. The base horizontal edge members 24 serve to connect the panel 22 forming the bottom of base 20 with the panels 22 forming the sides of base 20. The base horizontal edge member 24 is preferably formed with an outer skin 240 and an inner skin 242. A plurality of angled ribs 244 and intermediate ribs 246 are provided between the outer skin 240 and the inner skin 242. The angled ribs 244 and intermediate ribs 246 preferably traverse a 90 degree angle from end to end, but other angles are possible, depending on the angle at which adjacent panels 22 are to be joined. (A rectangular solid, six-sided case is the most common shape, but any shape case could be assembled by forming edge members and corner pieces to traverse the appropriate angles.) At least one longitudinal rib 248 is preferably provided between the outer skin 240 and the inner skin 242, such that the longitudinal rib 248 forms a plurality of substantially perpendicular intersections 250 with the angled ribs 244 and the intermediate ribs 246. The outer skin 240 is preferably formed with a plurality of protuberances 256 (the design and function of the protuberances 256 will be discussed in greater detail below).

The intersections 250 are preferably formed as bosses 250 with the areas of the inner skin 242 covering the centers of the bosses 250 removed to form a plurality of integral mounting holes 252 in the base horizontal edge member 24. Since the outer skin 240 is not penetrated, the mounting holes 252 do not affect the air- or water-tight integrity of the case 10, while allowing the attachment of accessories including mounting frames, racks, decks, and shock mounts. If more secure attachment of accessories is required, a hole is drilled through the outer skin 240 allowing a bolt or other fastener to be inserted through a mounting hole 252, in which case a sealant may be used to maintain air- or water-tight integrity of the case 10. The outer skin 240 is preferably formed with a flat surface 254 on a portion covering the bosses 250 to provide a space for washers, bolt heads, or other fastener surfaces.

The above demonstrates another advantageous aspect of the present invention. Unlike in conventional plywood cases, the edge members are formed as dual skinned members with internal ribs. The edge members formed in this fashion are correspondingly lighter, more air-/water-tight, and more impact resistant, thus out-performing the more conventional metal or other solid edging.

Turning to FIGS. 6A-G, a base vertical edge member 26 according to an embodiment of the present invention will be described. The base vertical edge members 26 are used to connect adjacent panels 22 forming the sides of base 20. The base vertical edge member 26 is provided with an outer skin 260 and an inner skin 262. A plurality of angled ribs 264 and intermediate ribs 266 are provided between the outer skin 260 and the inner skin 262. The angled ribs 264 and the intermediate ribs 266 preferably are formed to traverse a 90 degree angle, although they can be formed to traverse other angles, as discussed in connection with the base horizontal edge member 26, above. At least one longitudinal rib 268 is preferably provided between the outer skin 260 and the inner skin 262 such that it forms a plurality of substantially perpendicular intersections 270 with the angled ribs 264 and the intermediate ribs 266. The intersections 270 are preferably formed as bosses 270. The portions of inner skin 262 covering the centers of bosses 270 are removed to form a plurality of mounting holes 272, that are adapted for use as discussed in connection with the mounting holes 252, above. A flat surface 274 is provided on the outer skin 260 for use in connection with hardware inserted through the mounting holes 272, as discussed in connection with the flat surface 254, above.

The base vertical edge member 26 is most preferably formed with an integral corner piece 276. Alternatively, a separate corner piece could be provided or a corner piece could be integral to the base horizontal edge members 24. When the base vertical edge member 26 is connected between two panels 22, the integral corner piece 276 extends below the connection and is adapted for connection between two base horizontal edge members 24.

Figure 7:
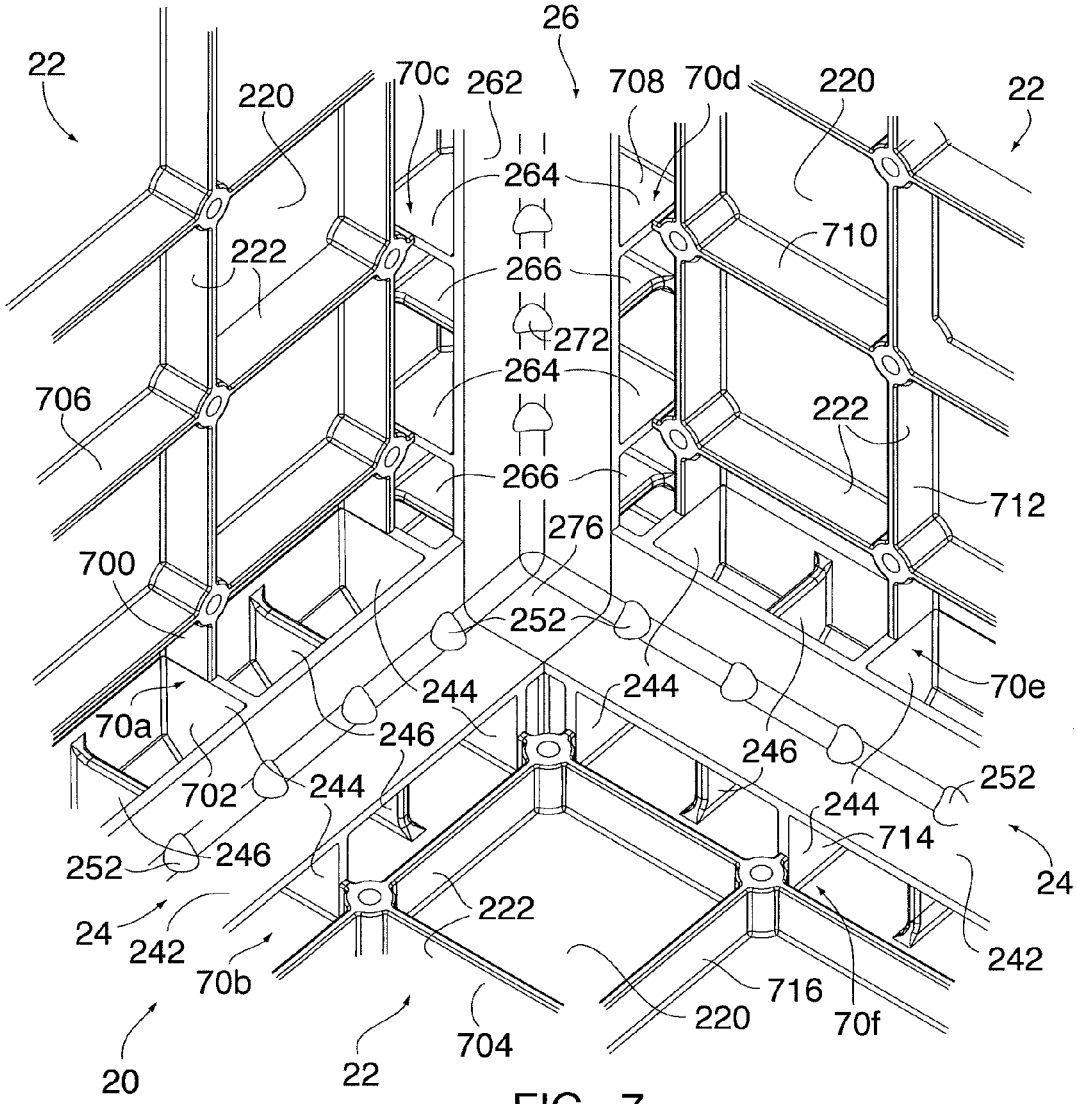
FIG. 7 shows an interior corner with inner half-panels removed to show internal structure according to the preferred embodiment of the present invention.
Figures 8A, 8B, 8C, 8D, 8E, 8F, 8G:
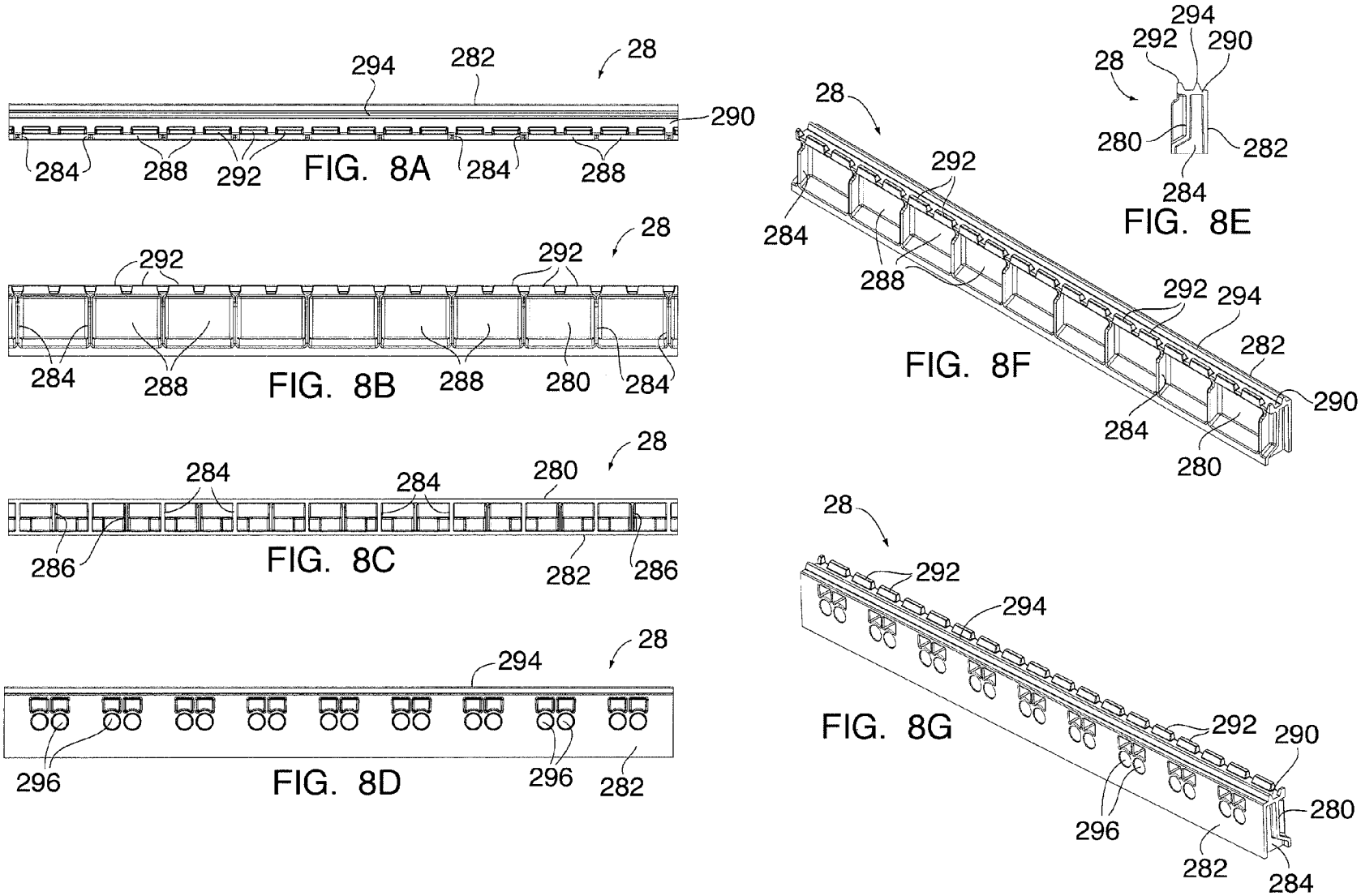
FIGS. 8A-G show various views of a base parting line edge member according to the preferred embodiment of the present invention.

The advantageous alignment of the ribs in the panels 22 and edge members 24 and 26 will now be explained. FIG. 7 shows a blow-up of an interior corner of the base 20 with inner panel halves 228 removed to show internal features. The interior corner shown is formed by the connection of three panels 22 with two base horizontal edge members 24 and a base vertical edge member 26. Where a panel is connected to an edge member a joint 70 is formed. A number of the ribs 222 terminate at the joint 70 (e.g., a rib 700 terminates at a joint 70*a*) and other ribs 222 nm parallel with the joint 70 (e.g., a rib 706 runs parallel with a joint 70*a*). The edge member 24, 26 angled ribs 244, 264 terminate at the joints 70 on two sides of the edge member (e.g., an angled rib 702 terminates at the joints 70*a* and 70*b*). As explained above, the spacing between any two adjacent parallel ribs 222 is equal. Most preferably, the spacing between any two adjacent angled ribs 244, 264 is also equal, and equal to the spacing between any two adjacent parallel ribs 222.

When the panels 22 and edge members 24, 26 are cut from stock to fabricate a case 10 of desired dimensions, the cuts are preferably made so that the ribs 222 and angled ribs 244, 264 terminating at the joints 70 will align end to end. When the connections are made, preferably by hot-plate welding, substantially integral ribs will be formed through the sides and around the edges and corners of the case 10. For example, the rib 700 and a rib 704 terminate at the joints 70*a* and 70*b*, respectively. The angled rib 702 terminates at both the joints 70*a* and 70*b*. The joint 70*a* is made such that an end of the rib 700 is joined to the end of angled rib 702. The joint 70*b* is made such that an end of the rib 704 is joined to another end of the angled rib 702. Joined in this manner, the rib 700, angled rib 702 and rib 704 form an integral rib through the joints 70*a* and 70*b*. Similarly, the rib 706, an angled rib 708, and a rib 710 form an integral rib through the joints 70*c* and 70*d*, and a rib 712, an angled rib 714, and a rib 716 form an integral rib through the joints 70*e* and 70*f*. The intermediate ribs 246, 266 are not joined to the panel ribs 222, but provide an edge member structure that is less susceptible to damage and abuse.

Yet another important advantage of the present invention is shown in this ability to transmit forces not only throughout the panels, but also throughout the edge members and the entire structure of the case. The alignment the plurality of ribs throughout the case provide greatly enhanced strength and toughness in a light and more air-/water-tight case.

By using the panels 22 and edge members 24, 26 with inner and outer skins, the connection area of the joint 70 is maximized. Preferably, the spacing between the panel outer skin 220 and inner skin 222 is equal to the spacing between the edge member outer skin 240, 260 and inner skin 242, 262. When a connection is made at the joint 70, then not only are the rib ends aligned, but also the edges of corresponding inner and outer skins lying along the joint 70. When the connection is made using hot-plate welding, the total weld area includes both the rib ends and also the corresponding edges of the inner and outer skins. The use of dual-skinned panels and edge members joined with the corresponding edges of the inner and outer skins aligned also provides a case with a smooth, seamless interior, which is useful for many applications.

As discussed above, the integral corner 276 of the base vertical edge member 26 is adapted for connection with the base horizontal edge members 24. The geometry of such a connection can be seen in FIG. 7. The integral corner 276 extends below the joints 70*c* and 70*d*. The preferred internal structure of the integral corner 276 (best seen in FIG. 6F) is such that when the base horizontal edge member 24 is connected as shown in FIG. 7, the longitudinal rib 248 (not shown in FIG. 7, but lying under the line of mounting holes 272) is aligned with and joined to an angled reinforcement 277 (best seen in FIGS. 6A, B and F) in the integral corner 276. With two base horizontal edge members 24 attached to the integral corner 276 in this manner a substantially integral longitudinal rib is formed through the integral corner 276, the substantially integral longitudinal rib also being tied into the vertical edge member longitudinal rib 268.

Figure 15:
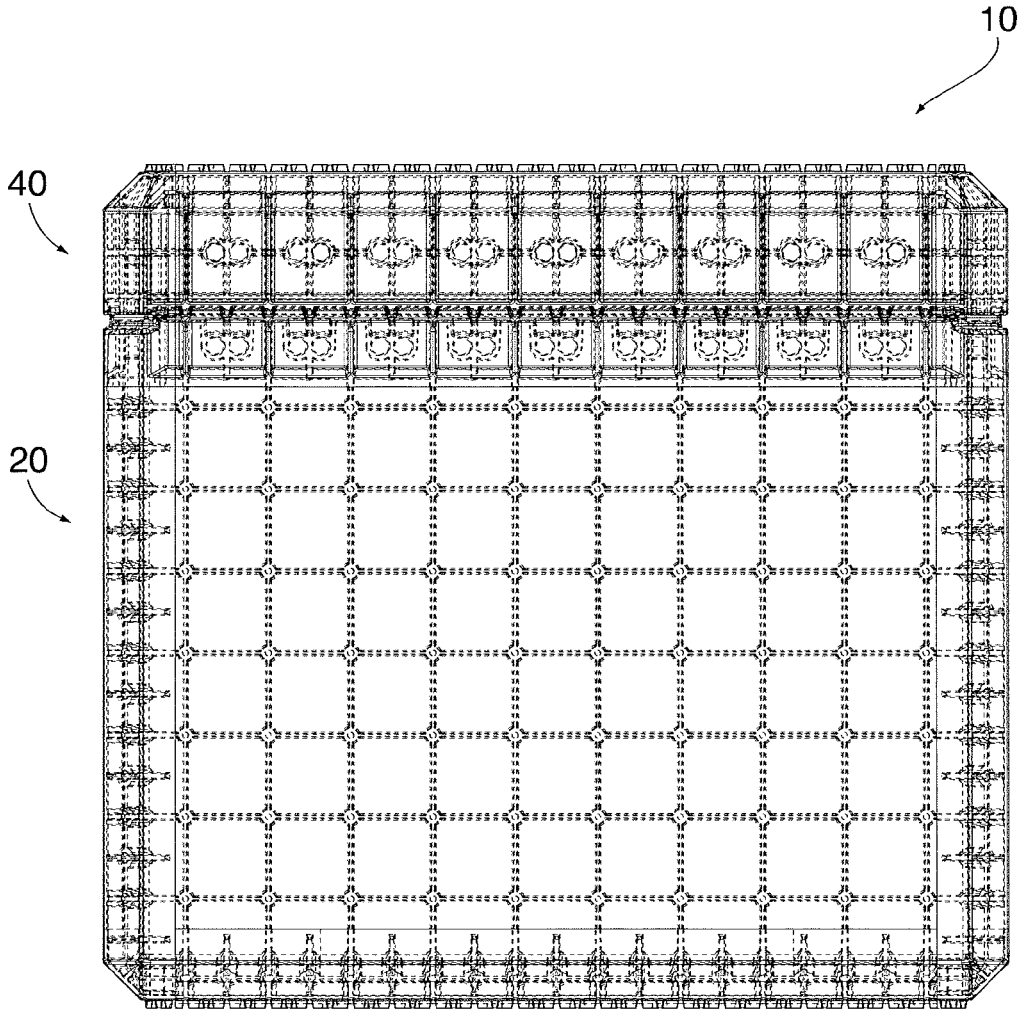
FIG. 15 shows a side view of a case illustrating the alignment of internal ribs in broken lines according to the preferred embodiment of the present invention.

From the foregoing it can be seen how the present invention provides a modular case with substantially integral ribs. Localized forces acting on the case 10 can thus be effectively distributed via the integral ribs throughout the structure of the case 10, resulting in an extremely strong and impact resistant case. Integrating the rib structure through edges and corners allows the case added strength at these particularly impact-susceptible locations. The dual-skin structure with internal ribs offers greater impact resistance and air-/water-tightness than known plywood cases, while also weighing substantially less than heavy-duty plywood cases engineered to provide similar attributes. FIG. 15 shows a side view of the case 10 with the internal ribs shown in broken lines, in which the overall alignment of internal ribs can be appreciated.

Turning now to FIGS. 8A-G, various views of the base parting line edge member 28 are shown. The base parting line edge members 28 are connected to the side panels 22 of the base 20, to allow the base 20 to effectively accommodate the lid 40. The base parting line edge member 28 is preferably formed with an outer skin 280 and an inner skin 282 and a plurality of ribs 284 and intermediate ribs 286. To allow for advantageous connection (as discussed above) to the panel 22, the spacing between adjacent parallel ribs 284 is equal to the spacing between adjacent parallel panel ribs 222, and the spacing between the outer skin 280 and the inner skin 282, along the edge of the parting line edge member adapted for connection to the panel 22, is equal to the spacing between the panel outer skin 220 and the inner skin 222. An upper portion of the outer skin 280 is recessed such that the ribs 284 extend beyond the recessed upper portion of the outer skin 280, forming a plurality of recesses 288.

The upper ends of outer skin 280 and inner skin 282 are connected by a parting line surface 290. The parting line surface 290 extends beyond the recessed upper portion of the outer skin 280 to partially overhang the recesses 288. A plurality of protuberances, preferably tabs 292, are formed on the portion of the parting line surface 290 overhanging the recesses 288. Toward an inner side of the parting line surface 290 an extended longitudinal ridge, or gasket penetrator 294, is preferably provided, spaced apart from and running parallel to the tabs 292. The tabs 292 and gasket penetrator 294 are adapted for advantageous engagement with corresponding features of the lid parting line edge member 42, as will be described below. Additionally, it is preferred that the base parting line edge member be formed to include a plurality of sockets 296. The sockets 296 are preferably formed as bosses extending between the outer skin 280 and the inner skin 282, accessible through openings formed in the inner skin 282. The sockets 296 are preferably arranged in socket pairs and adapted to allow for the advantageous mounting of hardware, as will be explained in detail, below.

Figure 9A:
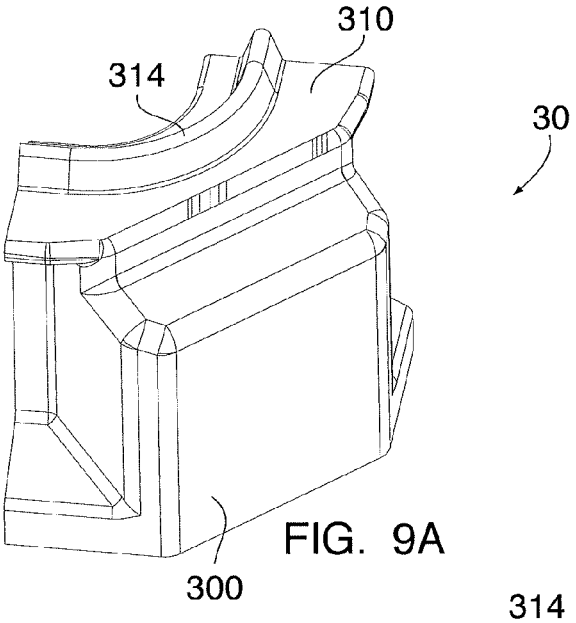
FIGS. 9A-C show various views of a base parting line corner piece according to the preferred embodiment of the present invention.
Figure 9B:
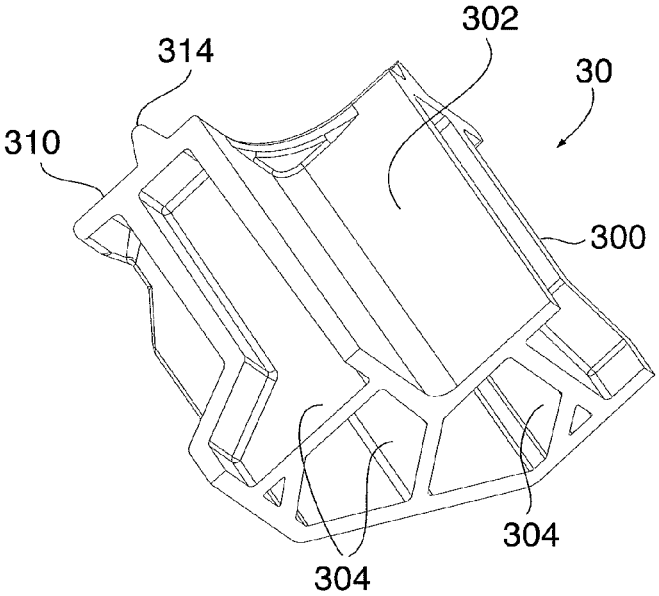
Figure 9C:
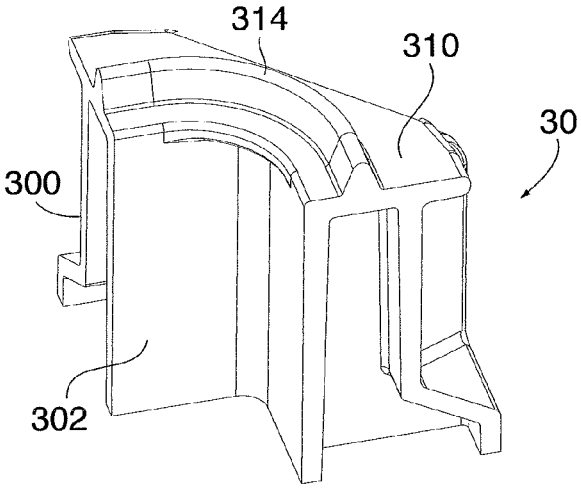
Figure 10A:
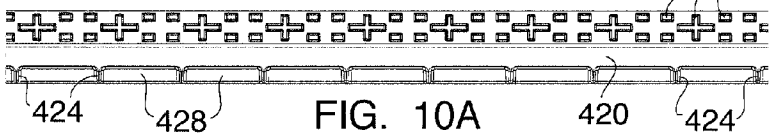
FIGS. 10A-G show various views of a lid parting line edge member according to the preferred embodiment of the present invention.
Figure 10B:
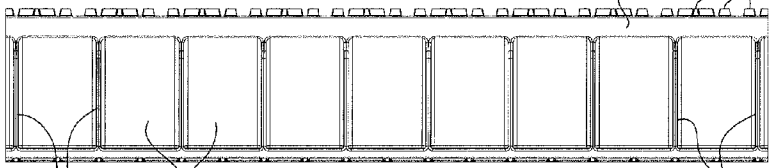
Figure 10C:
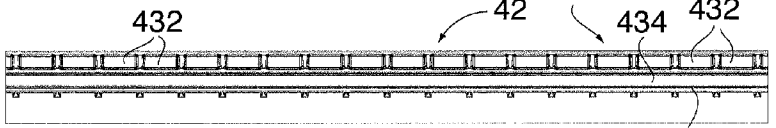
Figure 10D:
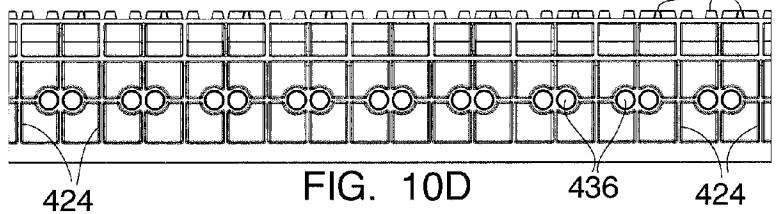
Figure 10E:
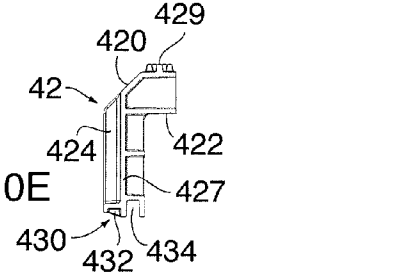
Figure 10F:
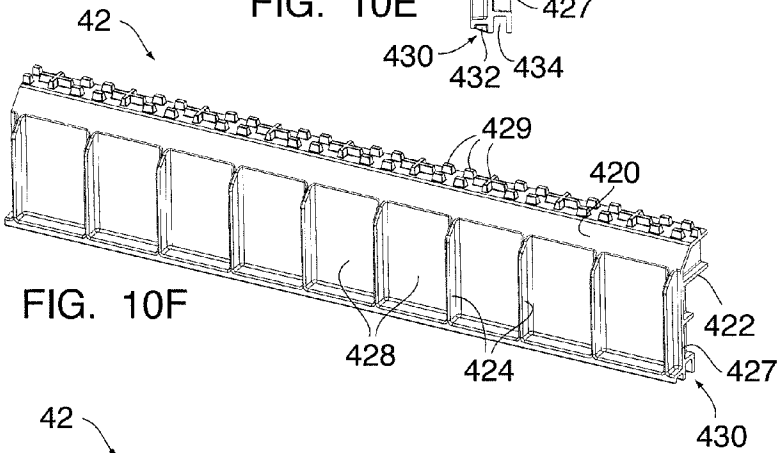
Figure 10G:
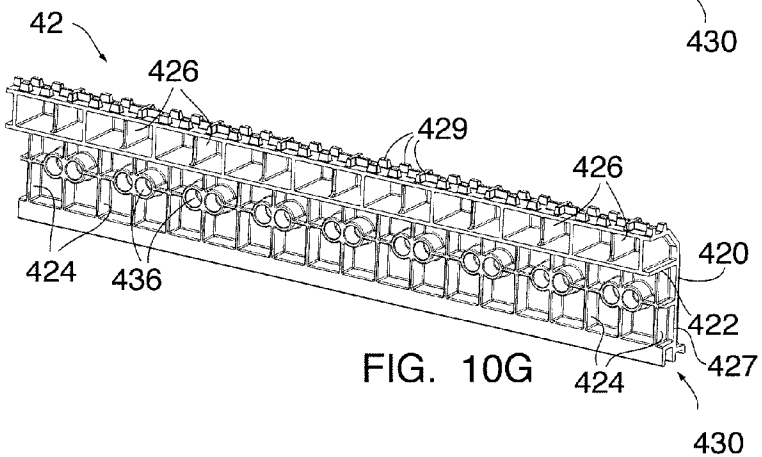

The base parting line corner pieces 30, shown in various views in FIGS. 9A-C, are connected to the tops of the base vertical edge members 26 and are connected between the base parting line edge members 28. The base parting line corner piece 30 is preferably formed with an outer skin 300 and an inner skin 302. An upper portion of the outer skin 300 is recessed on the edges of the base parting line corner piece 30 adapted for connection with the base parting line edge member 28, so as to match the profile of the outer skin 280. On the bottom edge of the base parting line corner piece 30, the spacing between the outer skin 280 and the inner skin 282 corresponds to the spacing between the base vertical edge member outer skin 260 and inner skin 262. A plurality of ribs 304 are provided, at least one of which continues the line of the base vertical edge member longitudinal rib 268. The upper ends of the outer skin 300 and the inner skin 302 are connected by a parting line surface 310, corresponding to the parting line surface 290. The line of gasket penetrator 294 is continued across the parting line surface 310 by a curved ridge, or gasket penetrator 314.

The structure of the lid 40 will now be discussed. The panel 22 forming the top of the lid 40 is preferably formed identically to the panels 22 that form the sides and bottom of the base 20. FIGS. 10A-G show various views of the lid parting line edge member 42. The lid parting line edge member 42 is adapted for connection to the panel 22, and formed to be effectively accommodated by the base parting line edge member 28. The lid parting line edge member 42 is provided with an outer skin 420 and an inner skin 422. The inner skin 422 preferably does not fully cover the interior surfaces of the lid parting line edge member 42, but only the interior surface along the edge adapted for connection with the panel 22. Providing the inner skin 422 along this edge increases the weld area when the panel 22 is hot-plate welded to the lid parting line edge member 42. The lid parting line edge member 42 is also provided with a plurality of ribs 424 and intermediate ribs 426. The ribs 424 and intermediate ribs 426 preferably traverse a 90 degree angle such that lid parting line edge member provides both an edge for connection to the panel 22 forming the top of the lid 40 and a parting line surface 430 for accommodation by the base parting line edge member 28. A longitudinal rib 427 is preferably provided such that it forms a plurality of substantially perpendicular intersections with the ribs 424 and intermediate ribs 426.

The outer skin 420 is recessed on a vertical portion of the lid parting line edge member 42 such that the ribs 424 protrude beyond the outer skin 420 on the vertical portion forming a plurality of recesses 428 that correspond to the recesses 288 on the base parting line edge member 28. The lid parting line edge member 42 is preferably provided with a plurality of protuberances 429 formed on the outer skin 420, and with a plurality of sockets 436 arranged along the longitudinal rib 427. The sockets 436 are preferably formed as bosses extending inward from the outer skin 420, and arranged as socket pairs. The parting surface 430 preferably includes a plurality of parting surface recesses 432 adapted to accommodate the tabs 292 of the base parting line surface 290. Spaced apart from the recesses 432 on parting line surface 430 is a continuous groove, preferably gasket groove 434. The groove 434 and the gasket penetrator 294 cooperate as described below.

Figure 11A:
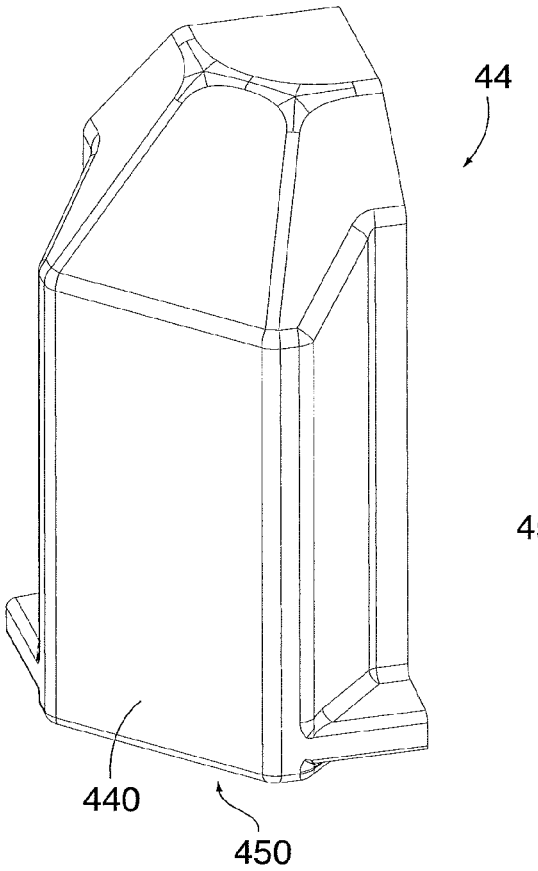
FIGS. 11A-C show various views of a lid parting line corner piece according to the preferred embodiment of the present invention.
Figure 11B:
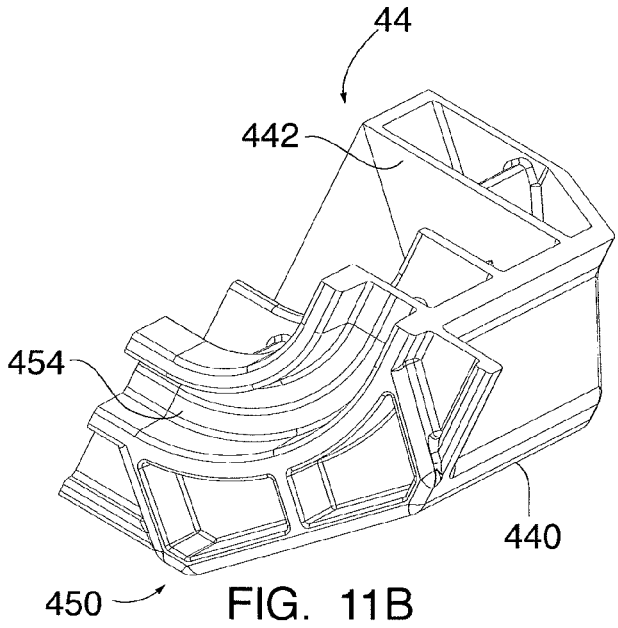
Figure 11C:
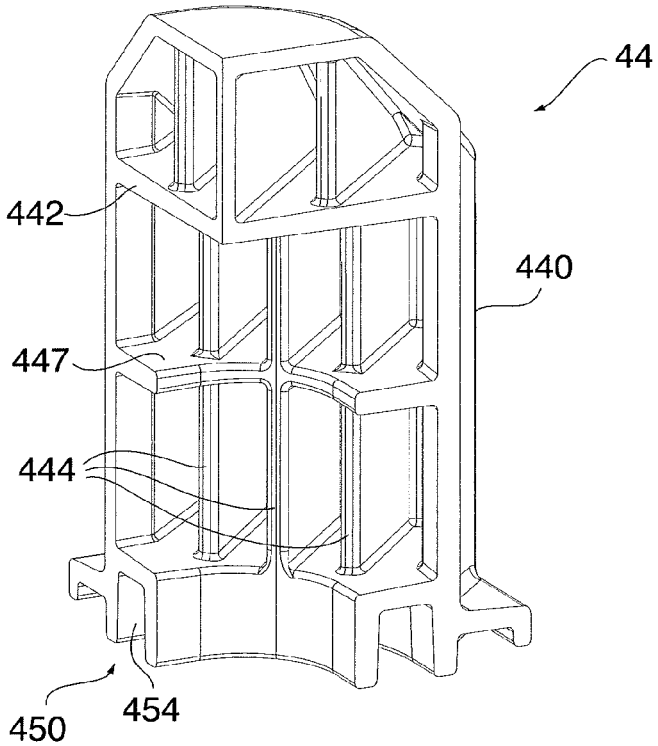

The lid parting line corner pieces 44, shown in various views in FIGS. 11A-C, connect the ends of adjacent lid parting line edge members 42 and are accommodated by the base parting line corner pieces 30. The lid parting line corner pieces 44 include an outer skin 440. An inner skin 442 is preferably provided only to correspond with the inner skin 422 of the lid parting line edge member 42. A plurality of vertical ribs 444 are provided, as is an angled rib 447. The angled rib 447 preferably traverses a 90 degree angle and is positioned to align with the longitudinal rib 427 when connected to the lid parting line edge member 42, advantageously forming an integral rib as discussed above. A parting line surface 450 is provided to align with the parting line surface 430 such that the line of the gasket groove 434 is continued through a curved groove 454 when the parting line corner piece 44 is connected to the parting line edge member 42.

Figure 12A:
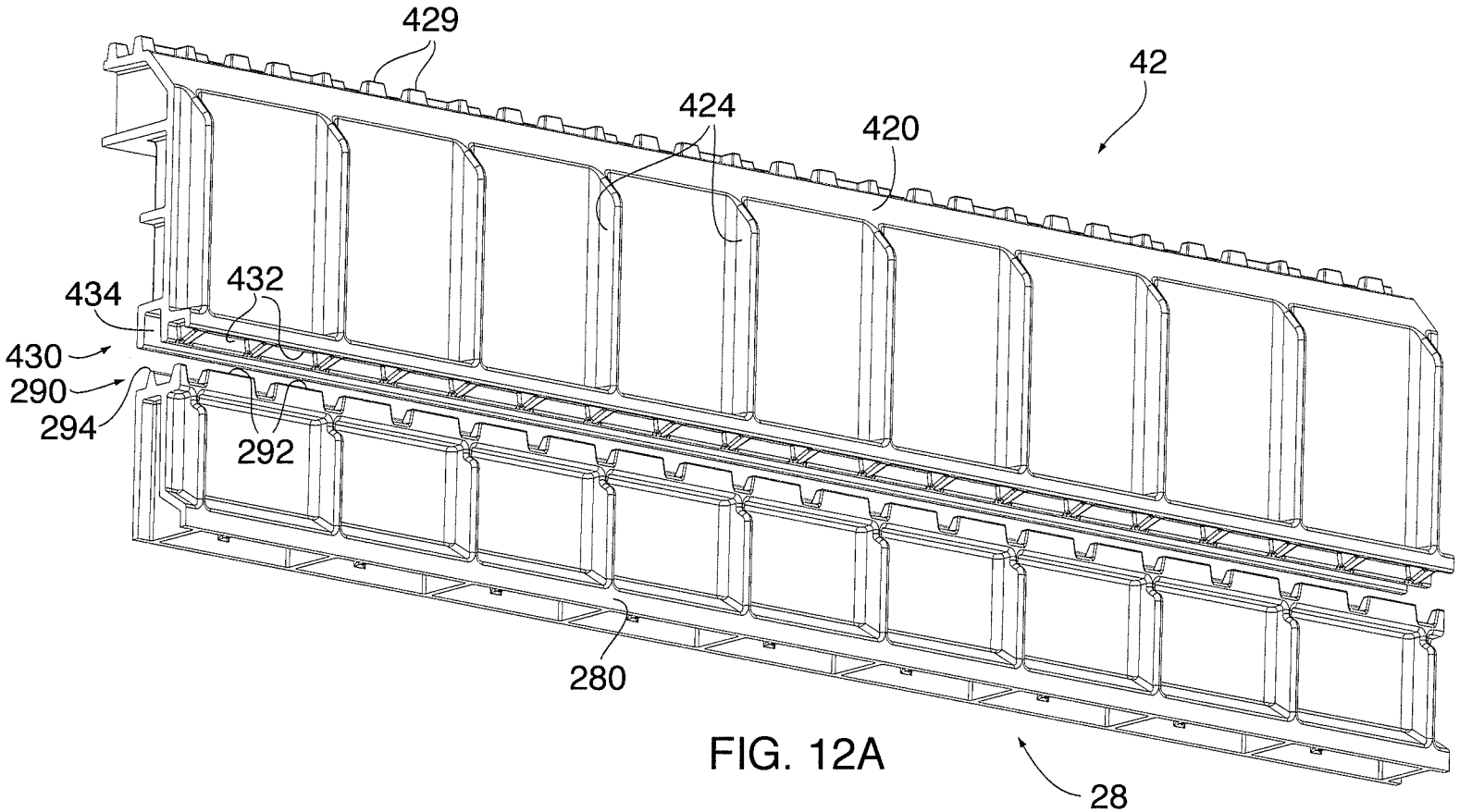
FIGS. 12A-C show various views illustrating the engagement of parting line members according to the preferred embodiment of the present invention.
Figure 12B:
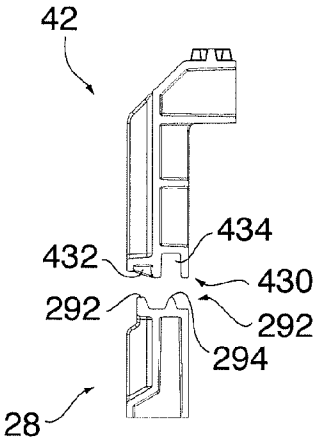
Figure 12C:
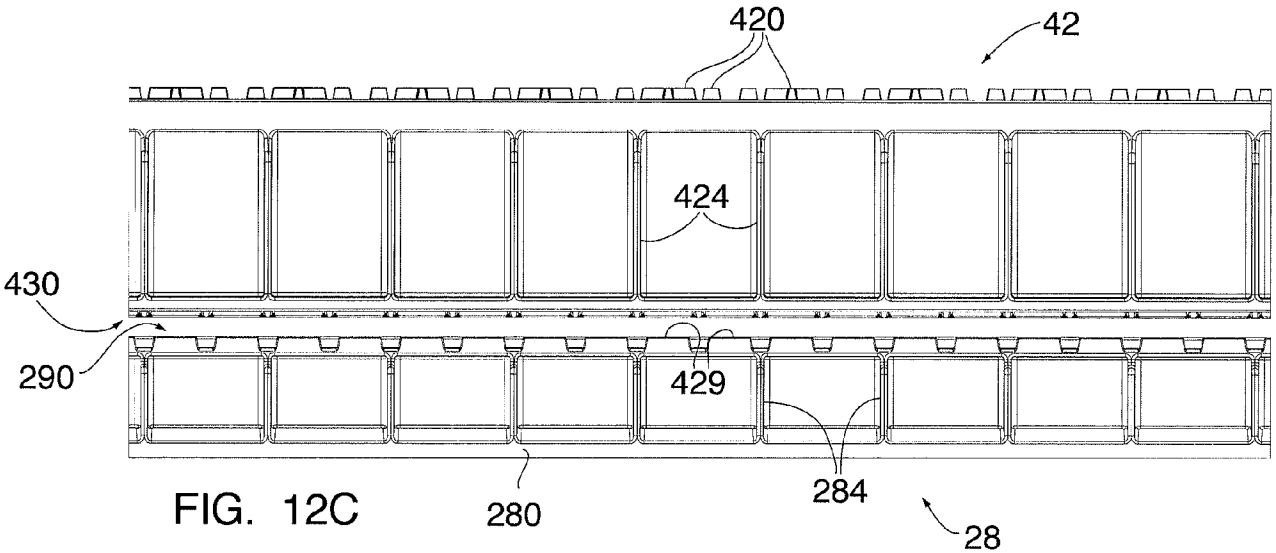

FIGS. 12A-C will be referenced to explain the cooperation between the lid parting line surface 430 and the base parting line surface 290. FIGS. 12A-C show various views of a lid parting line edge member 42 positioned over a base parting line edge member 28, such that the parting line surfaces 430 and 290 are aligned. (The parting line typically includes four (4) pairs of opposing edge members and four (4) pairs of opposing corner pieces, but since the engagement is preferably similar only one pair of opposing edge members are shown for simplicity.) When the parting line edge members 42 and 28 are held together by catches, or other lid fastening means known to those skilled in the art, the tabs 292 are inserted into the recesses 432. It can be appreciated that these multiple interlocking surfaces greatly reduce the possibility that shear forces (like those generated when the case 10 is dropped on a lid corner piece or edge member) will cause the lid 40 to separate from the base 20.

The groove 434 (which extends continuously along the lid parting line) is adapted to receive a compressible gasket (not shown). When the lid 40 and base 20 are held together, the gasket penetrator 294 compresses the gasket in the groove 434 along the entire perimeter of the parting line, establishing an air-/water-tight seal.

Figure 13A:
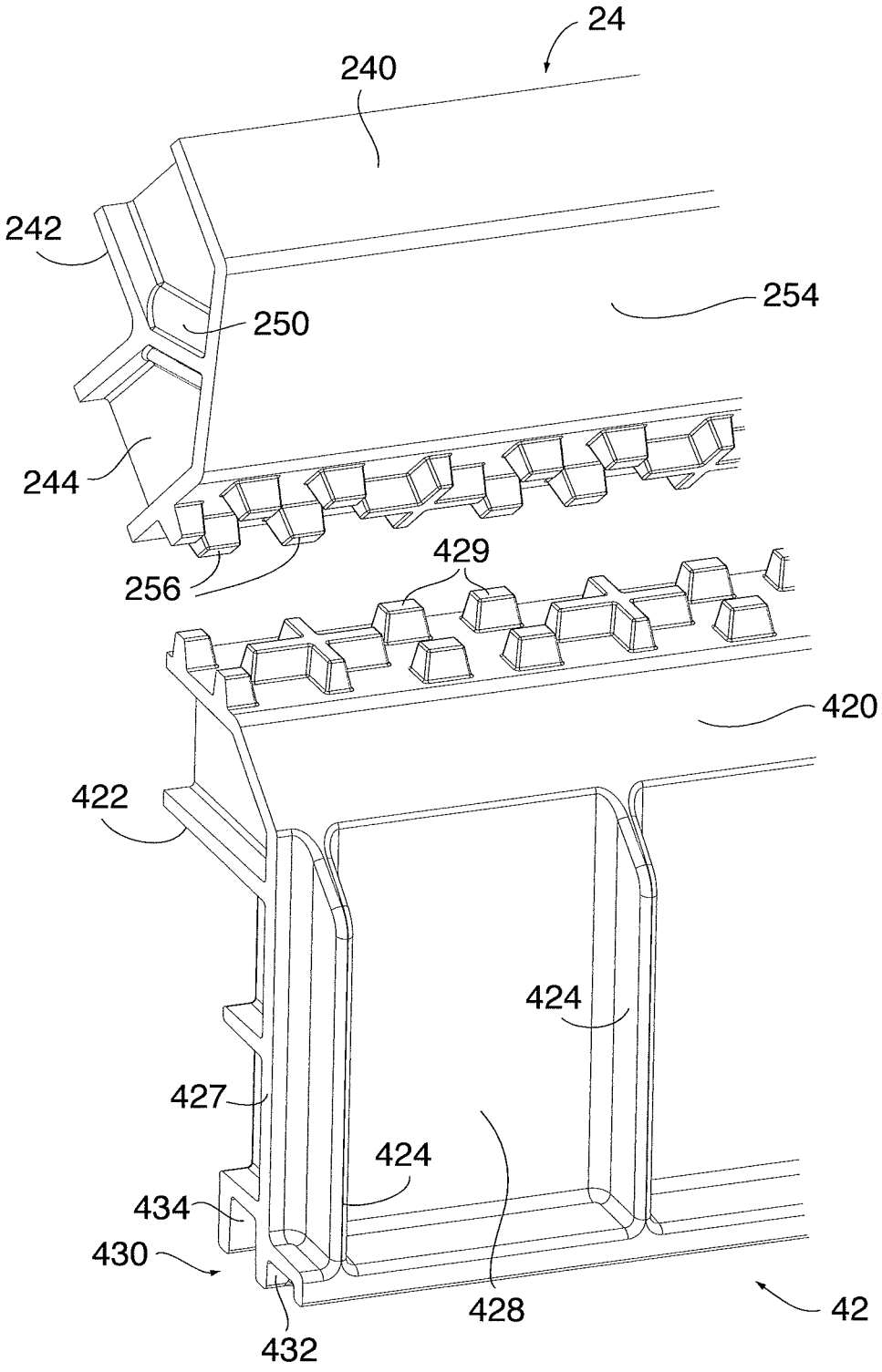
FIGS. 13A-E show various views illustrating the engagement of protuberances on base horizontal edge members and lid parting line edge members of stacked cases according to the preferred embodiment of the present invention.
Figure 13B:
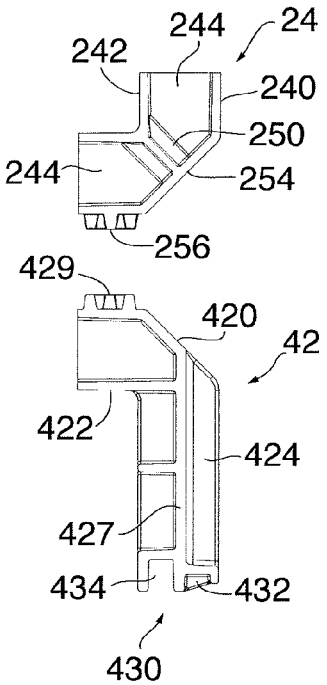
Figure 13C:
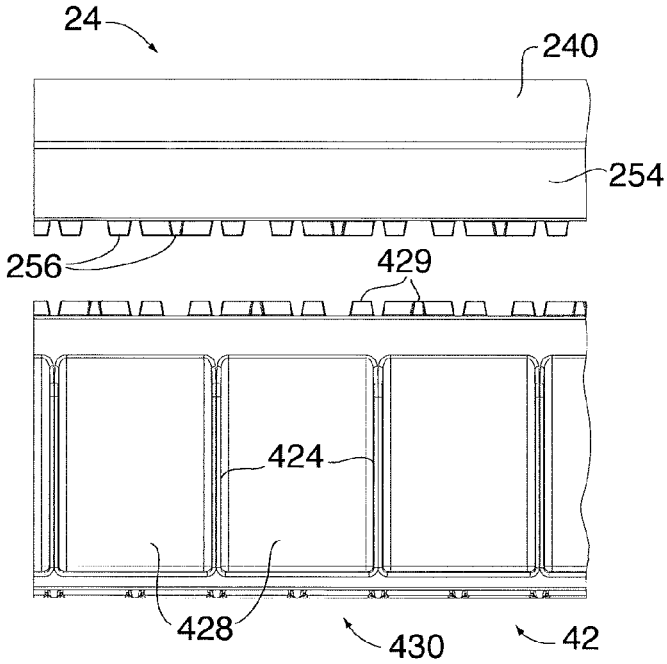
Figure 13D:
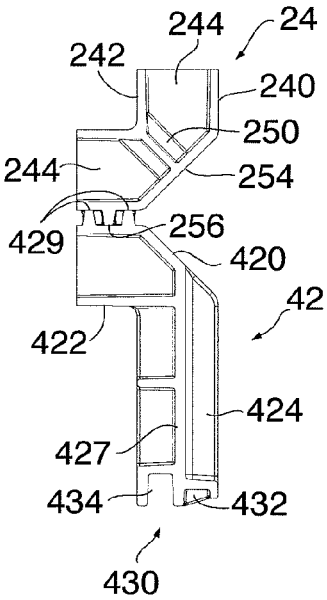
Figure 13E:
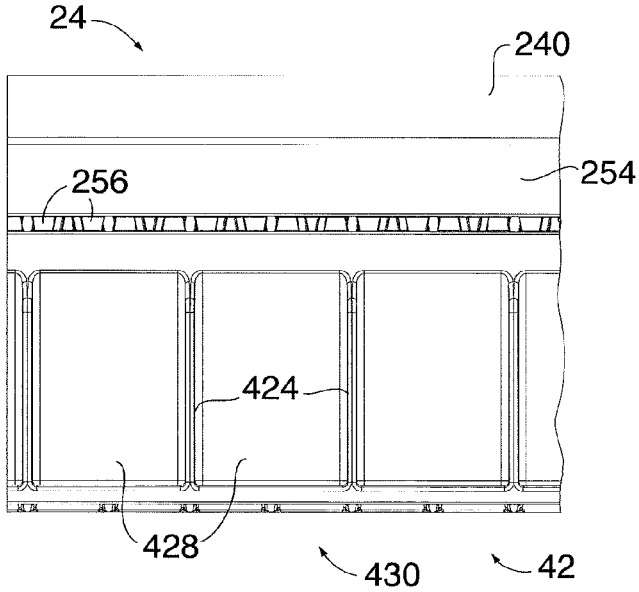

The advantageous cooperation between the protuberances 256 on the base horizontal edge member 24 and the protuberances 429 on the lid parting line edge member 42 will now be explained, referring to FIGS. 13A-E. FIG. 13A shows a perspective view, rotated for illustrative purposes only, of a base horizontal edge member 24 positioned over a lid parting line member 42. FIGS. 13B-E show various views of the same members before and after engagement. The protuberances 256 and 429 are preferably formed as cross and tab arrangements, such that four tabs engage an opposing cross. When two cases are stacked the interlocking tabs and crosses formed on the base horizontal edge member 24 of one case and the lid parting line edge member 42 of the second case engage, preventing side-to-side slippage between the two cases in all directions. When the two cases have the same X and Y dimensions, the cases can be stacked such that the tabs and crosses interlock along all opposing pairs of edge members. If the two cases do not have the same X and Y dimensions, aligning at least one corner allows tabs and crosses to interlock along at least two pairs of opposing edge members.

From the foregoing it can be seen how the molded protuberances and/or recesses on the base horizontal edge members 24, base parting line edge members 28, and lid parting line edge members 42 provided on the modular case 10 allow for advantageous engagement of the opposing top and bottom surfaces of two or more stacked cases, and of the opposing parting line surfaces on a given case.

Figure 14A:
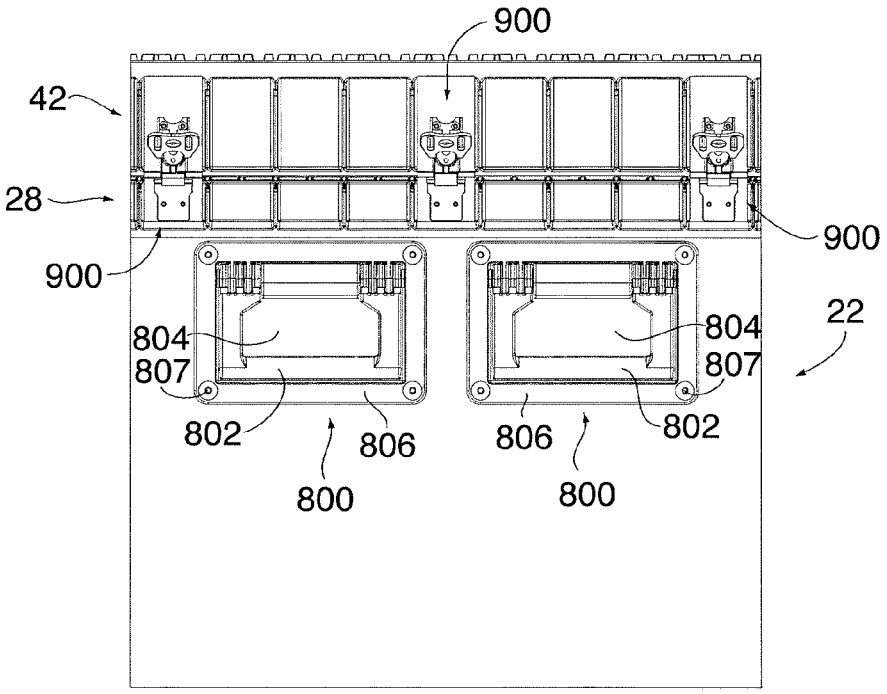
FIGS. 14A-F show various views illustrating the advantageous attachment of optional hardware according to the preferred embodiment of the present invention.
Figure 14B:
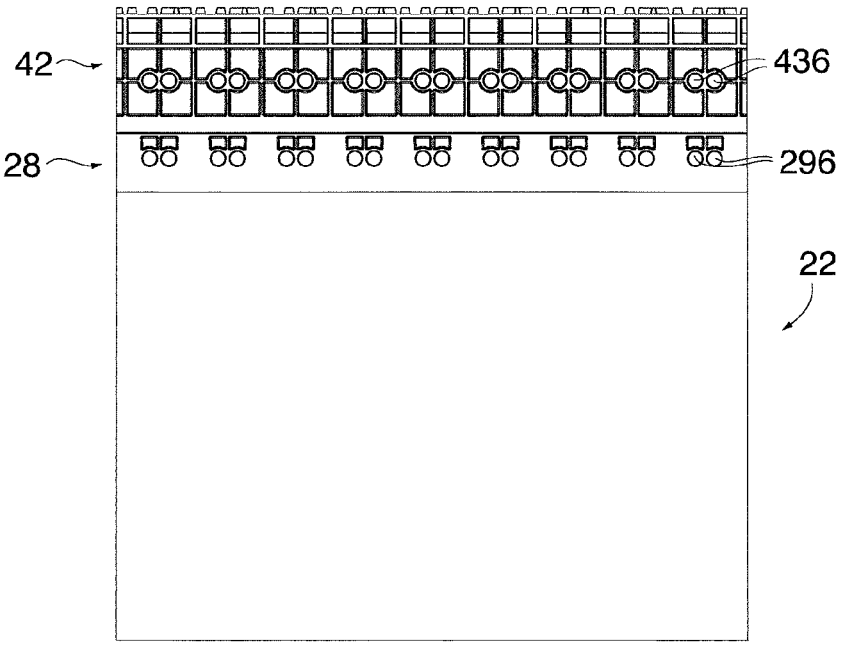

FIGS. 14A-B show front and back views of a side of case 10, according to a preferred embodiment of the present invention, wherein hardware is securely attached. Specifically, two handle assemblies 800 are shown attached to the panel 22, forming a side of the case 10, and three catch assemblies 900 are shown attached to the base parting line edge member 28 and lid parting line edge member 42 and securing those edge members together. Of course, other quantities of handles and catches and other hardware, known to those skilled in the art, can be advantageously attached, as required. As can be seen in FIG. 14B, no elements from the handle assemblies 800 or catch assemblies 900 can be seen protruding through the inner surface of the side of the case 10.

Figure 14C:
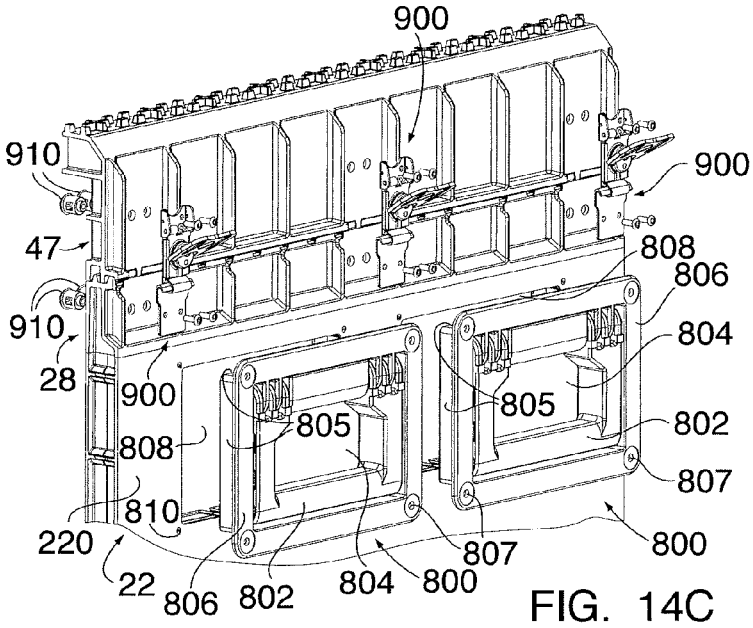
Figure 14D:
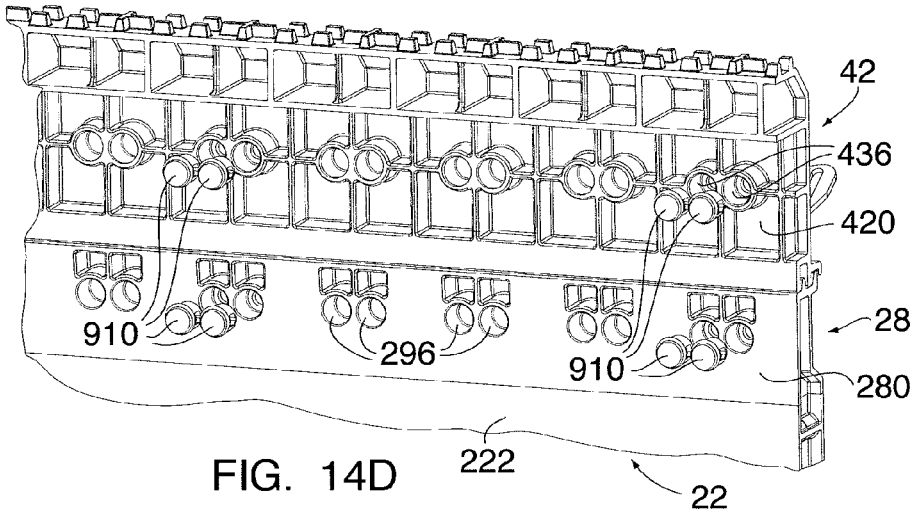

The attachment of the handle assemblies 800 can be most easily seen in FIG. 14C, in which the handle assemblies 800 are shown removed for illustrative purposes. A handle assembly 800 includes a handle 802 rotatably mounted inside a mounting well 804, the mounting well being bounded by four sides 805 (only two can be partially seen). A mounting flange 806 is provided perpendicular to the outer edges of the sides 805. A plurality of mounting holes 807 are provided in the flange 806. (Other handle designs are known, and can also be employed. The design of the handle assembly 800 depicted is advantageous, however, as it provides adequately sized handles while not substantially increasing the overall dimensions of the case 10.)

The handle assembly 800 is accommodated in the panel 22 by removing a portion of the outer skin 220 and the ribs 224 to form a handle recess 808 corresponding to the dimensions of the mounting well 804. The inner skin 222 is preferably left intact. When the mounting well 804 is inserted in the handle recess 808, the mounting flange 806 abuts the outer skin 220 around the handle recess 804. The handle assembly is secured to the case 10 by screws or other fasteners inserted through the mounting holes 807 and a plurality of holes 810 in the area of the outer skin 220 abutted by the mounting flange 806, but preferably not through the inner skin 222. Preferably, the handle assembly 800 is positioned such that the mounting holes 807 and holes 810 are aligned with bosses 230 (see FIG. 4), such that the screws or other fasteners securely engage the inside of the bosses 230. Forces acting on a handle assembly 800 so attached are distributed through the walls 805 to the ribs 222, and thus effectively distributed over a wide area of the case 10.

Figure 14E:
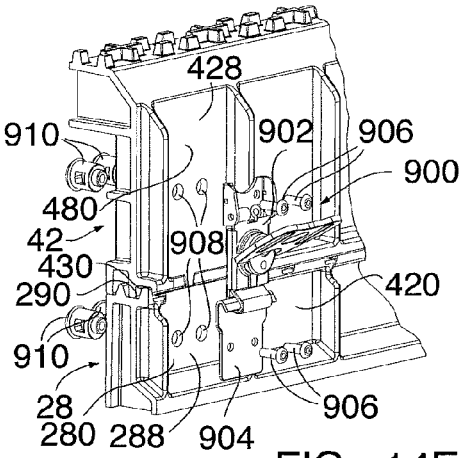
Figure 14F:
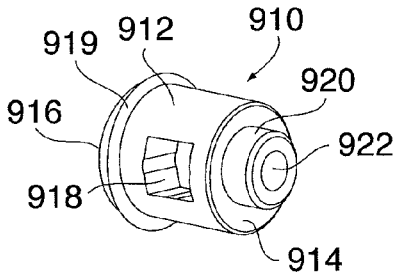

The attachment of the catch assemblies 900 can most easily be seen referring to FIGS. 14E-F, in which the catch assemblies 900 are shown removed for illustrative purposes. The catch assembly 900 is provided with a catch 902 and a catch strike 904 and is preferably attached in the corresponding recesses 428 and 288 on the lid and base parting line edge members 42 and 28, respectively, secured by rivets 906 or other fasteners inserted through a plurality of holes 908 in the outer skins 420 and 280. (Other types of catch assemblies are known to those skilled in the art and can be employed. The use of the assemblies shown, mounted in the recesses 428 and 288 allows for advantageous attachment of catch assemblies without increasing the overall dimensions of the case 10 and decreasing the likelihood that the catch assemblies 900 will be damaged or impacted during handling.)

The area of the parting line surface 290 overhanging the recess 288 and the corresponding area of the parting line surface 430 are preferably removed to allow the catch 902 and catch strike 904 to lie in the same plane. Air- and/or water-tight integrity is not affected by this partial removal of parting line surfaces as the gasket groove 434 and penetrator 294 are completely intact. The holes 908 are preferably made in the outer skins 420 and 280 to correspond to pairs of sockets 436 and 296, such that each rivet 906 extends into a corresponding socket 436 or 296 through a hole 908.

A plurality of mounting inserts 910 (seen enlarged in FIG. 14F) cooperate with the sockets 436 and 296 to advantageously distribute the forces exerted by rivets 906 on the outer skins 420 and 280 and to preserve the air-/water-tight integrity of the case 10. The mounting inserts 910 are preferably formed of metal or high-strength plastic. The mounting inserts 910 have a body 912 substantially corresponding to the volume of a socket 436 or 296, an outer face 914 and an inner face 916. The body 912 is formed with an expansion space 918. The body 912 is also preferably provided with an o-ring 919 arranged in a groove near the inner face 916. A nose 920 is preferably provided on the outer face 914. A bore 922 starts in the nose 920 and extends through the outer face 914 into the body 912. The bore 922 is sized to tightly accommodate a rivet 906. Preferably, the bore 922 does not extend through the inner face 916. (If the bore 922 extended through the inner face 916, some additional sealant may be used to maintain air-/water-tight integrity.)

The holes 908 in the outer skin 420 and 280 are sized to tightly accommodate the mounting insert noses 922 when a mounting insert 910 is inserted into a socket 436 or 296. When so inserted, o-ring 919 sealingly engages the walls of the socket 436 or 296, preventing communication through the holes 908 into the interior of the case 10. When a catch assembly 900 is secured by a rivet 906, the rivet 906 enters the bore 922 (the expansion space 918 allows for the body 912 to expand when accommodating a rivet 906) such that forces acting on the rivet 906 are not directly transmitted to the walls of the hole 908 but instead are distributed over a larger area.

From the foregoing it can be seen how features of the present invention, such as dual skinned panels and edge members, sockets, bosses, and mounting inserts allow for the secure attachment of hardware while preserving the air-/water-tight integrity of the case 10. Forces acting on hardware so attached are effectively distributed over larger areas than in conventional cases, minimizing the likelihood of hardware detachment, elongated rivet holes, and related problems.

While many advantages of the present invention can be clearly seen from the preferred embodiment described, it will be understood that the present invention is not limited to such an embodiment. Those skilled in the art will appreciate that many alterations and variations are possible within the scope of the present invention.

Additionally, panel designs other than the dual skinned panel 22 may be advantageously employed within the scope of the present invention. For example, while the dual-skinned panel 22 provides exceptional durability and allows for high air- and/or water-tight integrity, even when various attachments are secured to the case 10, in applications where a lighter case is desired, or where air- and/or water-tight integrity is not as critical a design factor, panels designs may be employed to retain many of the advantages of the dual-panel design with a substantial weight reduction.

Figure 16:
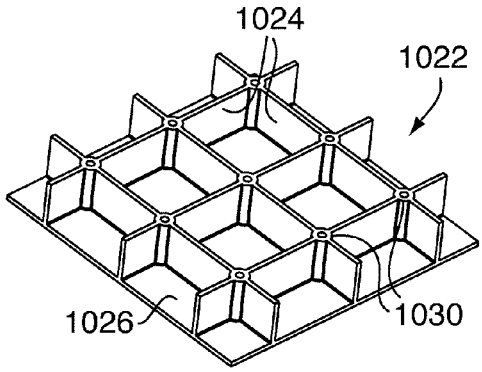
FIGS. 16-20 show perspective views of panels according to alternative embodiments of the present invention.
Figure 17:
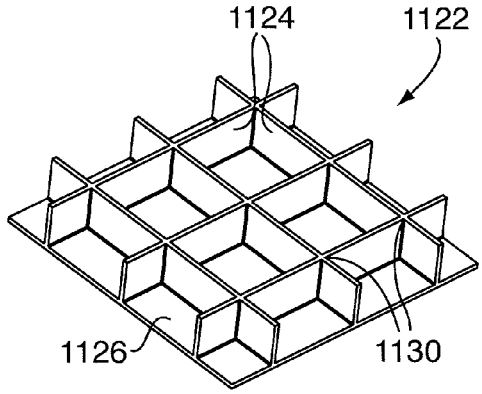

Referring to FIGS. 16-20, other panel embodiments will be described. In FIG. 16, a panel 1022 includes intersecting ribs 1024 formed on a panel skin 1026. The intersecting ribs 1024 intersect to form bosses 1030. The bosses 1030 can grippingly accommodate a threaded screw or the like. A panel 1122, shown in FIG. 17, is similar to the panel 1022, except the intersecting ribs 1124 on the panel skin 1126 do not form bosses at the intersections 1130.

Figure 18:
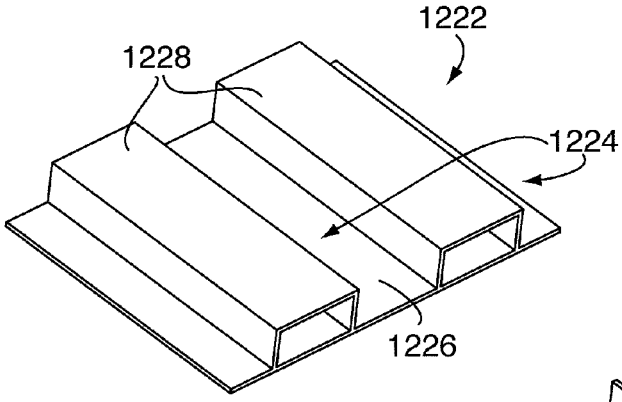
Figure 19:
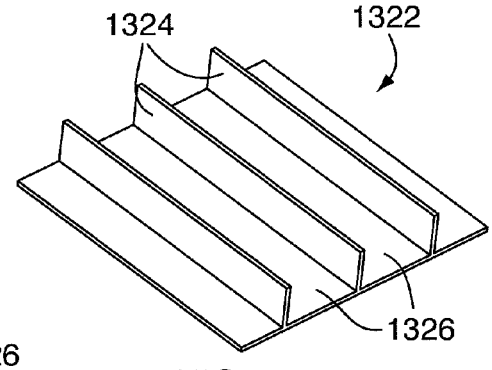

In FIG. 18, a panel 1222 has enclosed ribs 1224 formed on the panel skin 1226. The enclosed ribs 1224 each include a rib skin 1228. The enclosed ribs 1224 do not intersect but still allow for attachments to be made in the area between the panel skin 1226 and the rib skin 1228 without compromising the air- and/or water-tight integrity of the panel 1222. A panel 1322, as shown in FIG. 19, has ribs 1324 formed on a panel skin 1326. The ribs 1324 nm parallel and do not intersect, making the panel 1322 very light-weight relative to the other panel embodiments.

Figure 20:
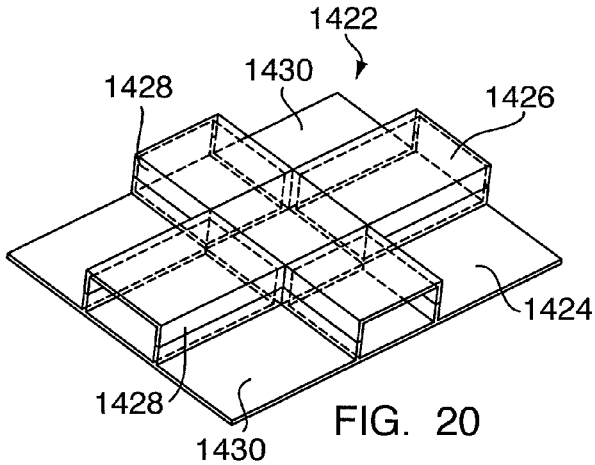

A panel 1422, as seen in FIG. 20, is formed with opposed panel skins 1424, 1426 on the surfaces of respective intersecting half-ribs 1428, in a manner similar to the panel 22, as described above. To reduce the overall weight of the panel 1422, a plurality of recess areas 1430 are formed by removal of the panel skin 1426 and the half-ribs 1428 in the recess areas 1430, typically by a machining process, or the like. In the areas where the panel skin 1426 remains intact, penetrations through only one of the panel skins 1424, 1426 will not compromise the air- and/or water-tight integrity of the panel 1422.

The panels of FIGS. 16-20 are connectable using the case edge members and corner pieces already described to form a modular case. Alternatively, the structure of the edge members and/or corner pieces can be modified in a similar fashion to the alternative panel embodiments to further reduce the overall weight of the modular case.

While many advantages of the present invention can be clearly seen from the embodiments described, it will be understood that the present invention is not limited to such embodiments. Those skilled in the art will appreciate that many alterations and variations are possible within the scope of the present invention.

What is claimed is:

1. A method for forming a modular case, the method comprising the steps of:

forming a master panel to have a skin and a plurality of panel reinforcing ribs extending outwardly therefrom;

forming a master edge member to have a skin and a plurality of edge member reinforcing ribs extending outwardly therefrom;

cutting the master panel into a plurality of case panels in accordance with a predetermined size of the modular case;

cutting the master edge member into a plurality of case edge members in accordance with the predetermined size of the modular case; and mating the case panels and the case edge members to one another so as to define the modular case;

wherein each of the panel reinforcing rib is aligned end-to-end with a corresponding edge member reinforcing rib, such that a plurality of substantially continuous ribs are formed at the intersection of said case panels and said case edge members, said continuous ribs being capable of distributing a force acting on the modular case.

2. The method of claim 1, wherein mating the case panels and the case edge members to one another so as to define the modular case includes hot-plate welding the case panels and the case edge members to one another.

3. The method of claim 1, wherein forming the master panel to have the skin and the plurality of panel reinforcing ribs extending outwardly therefrom includes forming the master panel to have dual skins with the plurality of panel reinforcing ribs extending between the dual skins.

4. The method of claim 3, further comprising the steps of:

removing a section of one of the dual skins of one of the case panels, the section sized in accordance with a size of a hardware assembly; and attaching the hardware assembly in the section;

wherein the hardware assembly does not penetrate the other of the dual skins of one of the case panels.

5. The method of claim 1, wherein forming the master edge member to have the skin and the plurality of edge member reinforcing ribs extending outwardly therefrom includes forming the master edge member to have dual skins with the plurality of edge member reinforcing ribs extending between the dual skins.

6. The method of claim 1, further comprising the steps of: forming a plurality of corner pieces to have a skin and a plurality of corner piece reinforcing ribs extending outwardly therefrom; and mating the corner pieces to the case edge members; wherein each of the corner piece reinforcing rib is are aligned end-to-end with a corresponding panel reinforcing rib, such that a plurality of substantially continuous ribs are formed at the intersection of said case panels and said case edge members, said continuous ribs being capable of distributing a force acting on the modular case.

* * * * *